US010245837B2

(12) United States Patent
Ueda

(10) Patent No.: US 10,245,837 B2
(45) Date of Patent: Apr. 2, 2019

(54) INKJET RECORDING APPARATUS INCLUDING SWITCH CAPABLE OF SWITCHING COMMUNICATION STATE BETWEEN DAMPER CHAMBER AND PUMP

(71) Applicant: BROTHER KOGYO KABUSHIKI KAISHA, Nagoya-shi, Aichi-ken (JP)

(72) Inventor: Toshiro Ueda, Inazawa (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/938,097

(22) Filed: Mar. 28, 2018

(65) Prior Publication Data

US 2018/0281422 A1 Oct. 4, 2018

(30) Foreign Application Priority Data

Mar. 31, 2017 (JP) ..... 2017-070385

(51) Int. Cl.

| | |
|---|---|
| ***B41J 2/17*** | (2006.01) |
| ***B41J 2/175*** | (2006.01) |
| ***B41J 2/14*** | (2006.01) |
| ***B41J 2/165*** | (2006.01) |
| ***B41J 29/02*** | (2006.01) |

(Continued)

(52) U.S. Cl.

CPC ..... *B41J 2/1707* (2013.01); *B41J 2/14201* (2013.01); *B41J 2/165* (2013.01); *B41J 2/175* (2013.01); *B41J 2/1752* (2013.01); *B41J 2/17509* (2013.01); *B41J 2/17513* (2013.01); *B41J 2/17523* (2013.01); *B41J 2/17553* (2013.01); *B41J 2/17556* (2013.01); *B41J 2/17596* (2013.01); *B41J 29/02* (2013.01);

(Continued)

(58) Field of Classification Search

CPC .. B41J 2/1707; B41J 2/17553; B41J 2/17556; B41J 2/17596; B41J 2/14201; B41J 2002/14483

USPC ..... 347/47, 85, 86, 94

See application file for complete search history.

(56) References Cited

U.S. PATENT DOCUMENTS 8,459,786 B2 * 6/2013 Ito ..... B41J 2/17509 347/85

2005/0212874 A1 * 9/2005 Nomura ..... B41J 2/17503 347/84

(Continued)

FOREIGN PATENT DOCUMENTS

JP 2003-170607 A 6/2003

*Primary Examiner* — Huan Tran

*Assistant Examiner* — Alexander D Shenderov

(74) *Attorney, Agent, or Firm* — Merchant & Gould P.C.

(57) ABSTRACT

An inkjet recording apparatus to which a cartridge is attachable includes: a tank including a storage chamber and an outlet port; a recording portion including a damper chamber and a recording head; an ink passage; a pump configured to suck fluid in the damper chamber; a first switch; and a controller. After attachment of the cartridge, the controller is configured to perform an initial ink introduction process to supply the ink from the cartridge to the storage chamber. The initial ink introduction process includes: a first suction process to drive the pump for a first period of time in a state where the first switch is in a first state to allow ink in the storage chamber to be sucked toward the damper chamber; and after performing the first suction process, an open process to switch the first switch to a second state.

9 Claims, 16 Drawing Sheets

(51) Int. Cl.
*B41J 29/13* (2006.01)
*B41J 29/38* (2006.01)

(52) U.S. Cl.
CPC ..... *B41J 29/13* (2013.01); *B41J 29/38* (2013.01); *B41J 2002/14483* (2013.01)

(56) References Cited

U.S. PATENT DOCUMENTS

2006/0132554 A1* 6/2006 Ota ..... B41J 2/17556
347/85
2007/0229572 A1* 10/2007 Nishida ..... B41J 2/17509
347/19
2008/0198207 A1* 8/2008 Katada ..... B41J 2/175
347/85
2009/0219323 A1* 9/2009 Silverbrook ..... B41J 2/175
347/17
2015/0273854 A1* 10/2015 Ito ..... B41J 2/19
347/92
2017/0120617 A1* 5/2017 Matsumura ..... B41J 2/17509

* cited by examiner

INKJET RECORDING APPARATUS INCLUDING SWITCH CAPABLE OF SWITCHING COMMUNICATION STATE BETWEEN DAMPER CHAMBER AND PUMP

CROSS REFERENCE TO RELATED APPLICATION

This application claims priority from Japanese Patent Application No. 2017-070385 filed Mar. 31, 2017. The entire content of the priority application is incorporated herein by reference.

TECHNICAL FIELD

The present disclosure relates to an inkjet recording apparatus provided with a tank to which ink from a cartridge is supplied.

BACKGROUND

There is known an inkjet recording apparatus provided with an apparatus body and a cartridge detachably attached thereto. The cartridge is configured to supply ink stored therein to the tank. The apparatus body includes a tank configured to store ink from the cartridge therein and a recording head to which ink is supplied from the tank.

In such an inkjet recording apparatus, ink is not stored in the tank in an initial state (i.e., the inkjet recording apparatus has been unused). Thus, when the inkjet recording apparatus in the initial state is used for the first time, a cartridge is attached to the inkjet recording apparatus, and ink in the cartridge needs to be supplied the tank. Further, ink in the tank needs to be supplied to the recording head.

Japanese Patent Application Publication No. 2003-170607 discloses an inkjet recording apparatus having a configuration capable of supplying ink from a cartridge to a tank and to a recording head smoothly. In this inkjet recording apparatus, an ink supply process for supplying ink from the cartridge to the tank is first executed, and thereafter, a suction process closing an ink pipe connecting the cartridge and the ink and generating negative pressure in the recording head to thereby allow the ink stored in the tank to be sucked toward the recording head is executed.

SUMMARY

In the inkjet recording apparatus disclosed in Japanese Patent Application Publication No. 2003-170607, in order to restrain air from entering from the tank to the recording head during the suction process, a certain amount of ink enough to prevent air from flowing out toward the recording head in the suction process needs to be stored in the tank during the ink supply process. Thus, when it takes a long time to supply ink into the tank during the ink supply process, a timing when the suction process for supplying ink stored in the tank to the recording head starts may be delayed.

In view of the foregoing, it is an object of the disclosure to provide an inkjet recording apparatus in which ink can be supplied to a tank within a short period of time in an initial state of the inkjet recording apparatus.

In order to attain the above and other objects, according to one aspect, the disclosure provides an inkjet recording apparatus to which a cartridge is attachable. The cartridge is formed with a storage space for storing ink and includes a first air flow path allowing the storage space to be communicated with an atmosphere. The inkjet recording apparatus includes: a tank; a recording portion; an ink passage; a pump; a first switch; and a controller. The tank includes: a storage chamber for storing ink supplied from the cartridge; an outlet port through which the ink stored in the storage chamber is allowed to flow out; and a second air flow path configured to allow the storage chamber to be communicated with the atmosphere. The recording portion includes: a damper chamber for storing ink supplied from the storage chamber; and a recording head. The damper chamber is positioned higher than the outlet port in an up-down direction and fluidly communicated with the storage chamber. The recording head includes a nozzle and is configured to eject the ink stored in the damper chamber through the nozzle. The ink passage is configured to communicate the storage chamber with the damper chamber. The ink stored in the storage chamber is supplied to the damper chamber through the outlet port and the ink passage. The pump is configured to suck fluid in the damper chamber. The first switch is configured to be switched between a first state and a second state. The first switch in the first state enables the pump to suck the fluid stored in the damper chamber whereas the first switch in the second state causes the pump not to suck the fluid stored in the damper chamber. The first switch in the first state is configured to interrupt fluid communication of the damper chamber with the atmosphere whereas the first switch in the second state allows fluid communication of the damper chamber with the atmosphere. The controller is capable of controlling the first switch and the pump. The controller is configured to perform: after attachment of the cartridge to the inkjet recording apparatus, an initial ink introduction process comprising: a first suction process to drive the pump for a first period of time in a state where the first switch is in the first state, the ink stored in the storage space being sucked toward the damper chamber through the storage chamber during the first period of time; and after performing the first suction process, an open process to switch the first switch to the second state.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1A:
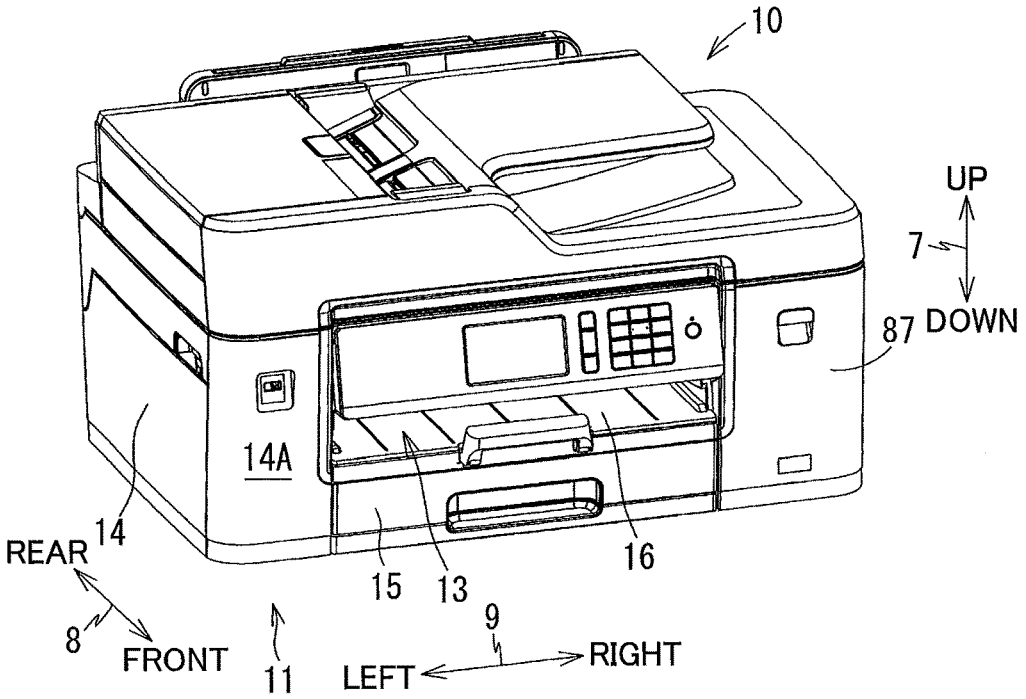
FIG. 1A is a perspective view of a multifunction peripheral 10 according to one embodiment of the present disclosure, and illustrating a closed position of a cover 87 of the multifunction peripheral 10.

A multifunction peripheral 10 as an example of an inkjet recording apparatus according to one embodiment of the present disclosure will be described with reference to the accompanying drawings, wherein like parts and components are designated by the same reference numerals to avoid duplicating description. It would be apparent that the embodiment described below is merely an example of the disclosure and may be modified in many ways without departing from the scope of the disclosure.

In the following description, up, down, front, rear, left, and right directions related to the multifunction peripheral 10 will be referred to assuming that the multifunction peripheral 10 is disposed on a horizontal plane so as to be operable, as shown in FIG. 1A. Note that this posture of the multifunction peripheral 10 illustrated in FIG. 1A will also be referred to as an "operable posture". Specifically, an up-down direction 7 of the multifunction peripheral 10 is defined based on the operable posture of the multifunction peripheral 10. A front-rear direction 8 is defined assuming that a surface of the multifunction peripheral 10 formed with an opening 13 is a front surface of the multifunction peripheral 10 in the operable posture. A left-right direction 9 is defined based on an assumption that the multifunction peripheral 10 in the operable posture is viewed from its front surface. In the present embodiment, in the operable posture of the multifunction peripheral 10, the up-down direction 7 is parallel to a vertical direction, and the front-rear direction 8 and the left-right direction 9 are parallel to a horizontal direction. Further, the front-rear direction 8 is perpendicular to the left-right direction 9.

<Overall Structure of Multifunction Peripheral 10>

Figure 1B:
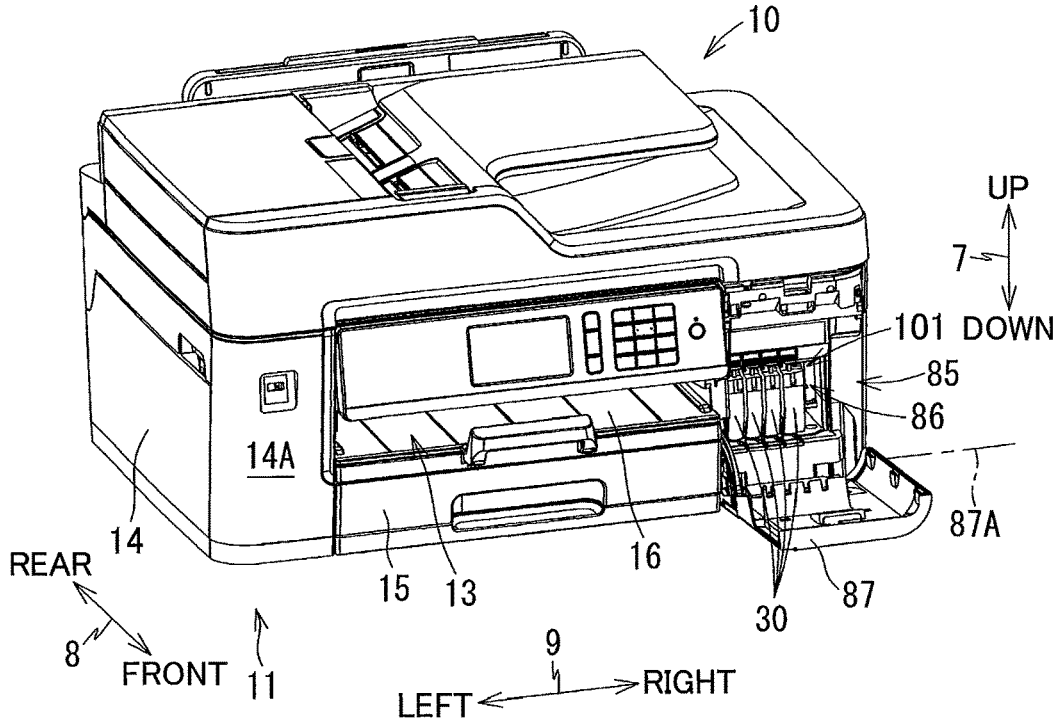
FIG. 1B is a perspective view of the multifunction peripheral 10 according to the embodiment, and illustrating an open position of the cover 87.

As illustrated in FIGS. 1A and 1B, the multifunction peripheral 10 has a substantially rectangular parallelepiped shape. The multifunction peripheral 10 has a lower portion in which a printer portion 11 is provided. The printer portion 11 is configured to record an image on a sheet of paper 12 (see FIG. 2) based on an inkjet recording method. The printer portion 11 includes a casing 14 whose front surface 14A is formed with the opening 13.

Figure 2:
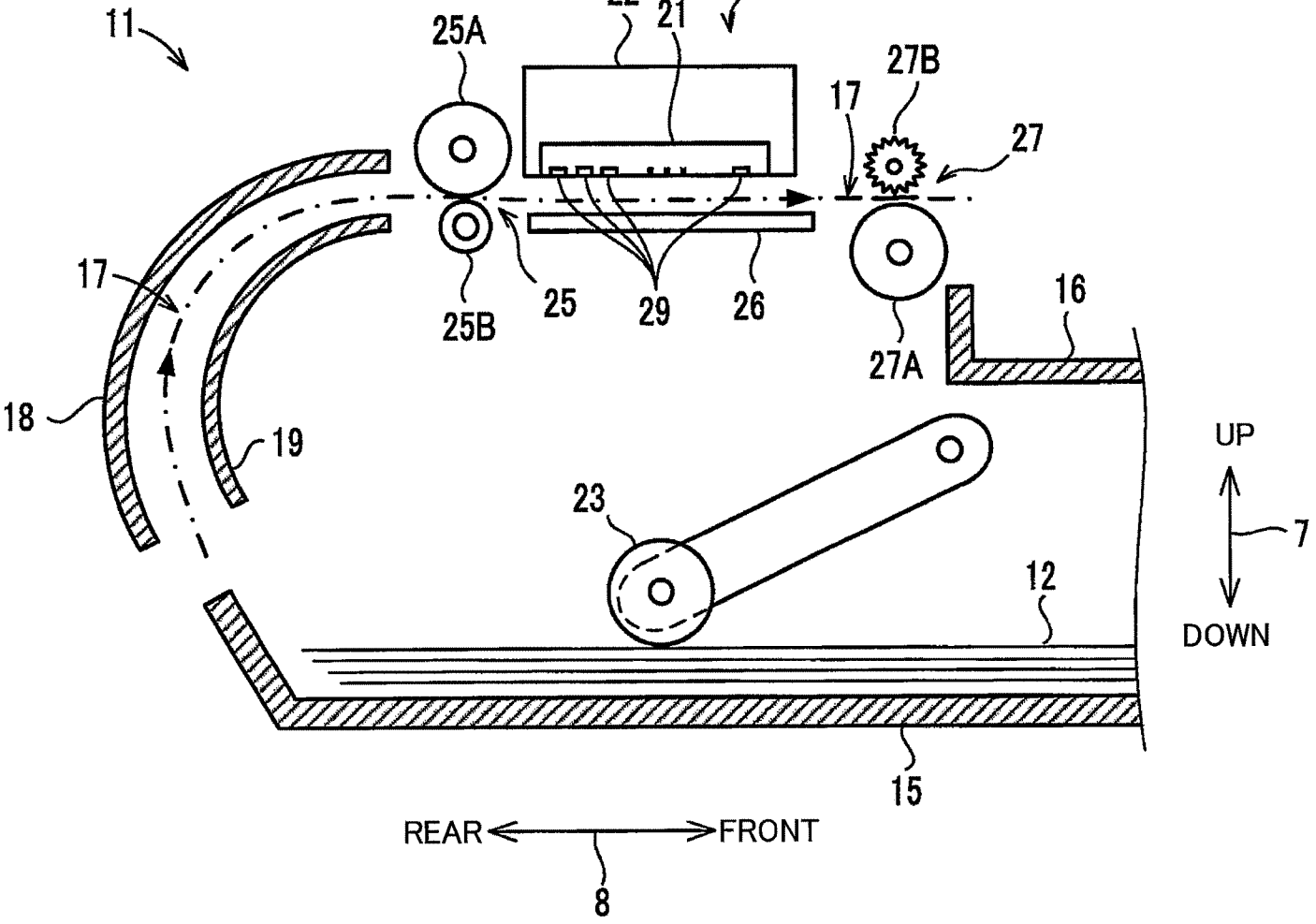
FIG. 2 is a vertical cross-sectional view schematically illustrating an internal configuration of a printer portion 11 of the multifunction peripheral 10 according to the embodiment.

As illustrated in FIG. 2, within the casing 14, a feeding roller 23, a feeding tray 15, a discharge tray 16, a pair of conveying rollers 25, a recording portion 24, a pair of discharging rollers 27, a platen 26, and a case 101 (see FIG. 1B) are disposed. The multifunction peripheral 10 has various functions such as a facsimile function and a printing function.

<Feeding Tray 15, Discharge Tray 16, and Feeding Roller 23>

As illustrated in FIGS. 1A and 1B, the feeding tray 15 is configured to be inserted into and extracted from the casing 14 through the opening 13 in the front-rear direction 8 by a user. The opening 13 is positioned at a center portion of the front surface 14A of the casing 14 in the left-right direction 9. As illustrated in FIG. 2, the feeding tray 15 is configured to support the sheets 12 in a stacked state.

The discharge tray 16 is disposed above the feeding tray 15. The discharge tray 16 is configured to support the sheets 12 discharged by the discharging rollers 27.

The feeding roller 23 is configured to feed each of the sheets 12 supported in the feeding tray 15 onto a conveying path 17. The feeding roller 23 is configured to be driven by a feeding motor 172 (see FIG. 8).

<Conveying Path 17>

As illustrated in FIG. 2, the conveying path 17 is a space partially defined by an outer guide member 18 and an inner guide member 19 opposing each other at a predetermined interval inside the printer portion 11. The conveying path 17 extends rearward from a rear end portion of the feeding tray 15, and then, makes a U-turn frontward while extending upward at a rear portion of the printer portion 11, passes through a space between the recording portion 24 and the platen 26, and reaches the discharge tray 16. A portion of the conveying path 17 positioned between the conveying rollers 25 and the discharging rollers 27 is provided substantially at a center portion of the multifunction peripheral 10 in the left-right direction 9, and extends in the front-rear direction 8. A conveying direction of each sheet 12 in the conveying path 17 is indicated by a dashed-dotted arrow in FIG. 2.

<Conveying Rollers 25>

As illustrated in FIG. 2, the pair of conveying rollers 25 is disposed at the conveying path 17. The conveying rollers 25 include a conveying roller 25A and a pinch roller 25B arranged to oppose each other. The conveying roller 25A is configured to be driven by a conveying motor 171 (see FIG. 8). The pinch roller 25B is configured to be rotated following rotation of the conveying roller 25A. As the conveying roller 25A makes forward rotation in response to forward rotation of the conveying motor 171, each of the sheets 12 is nipped between the conveying roller 25A and the pinch roller 25B to be conveyed in the conveying direction (i.e., frontward direction).

<Discharging Rollers 27>

As illustrated in FIG. 2, the pair of discharging rollers 27 is disposed downstream relative to the pair of conveying rollers 25 in the conveying direction at the conveying path 17. The discharging rollers 27 include a discharging roller 27A and a spur 27B arranged to oppose each other. The discharging roller 27A is configured to be driven by the conveying motor 171 (see FIG. 8). The spur 27B is configured to be rotated following rotation of the discharging roller 27A. As the discharging roller 27A makes forward rotation in response to the forward rotation of the conveying motor 171, each sheet 12 is nipped between the discharging roller 27A and the spur 27B and is conveyed in the conveying direction (i.e., frontward direction).

<Recording Portion 24>

As illustrated in FIG. 2, the recording portion 24 is disposed at a position between the conveying rollers 25 and the discharging rollers 27 at the conveying path 17. The recording portion 24 is arranged to oppose the platen 26 in the up-down direction 7, with the conveying path 17 interposed between the recording portion 24 and the platen 26. The recording portion 24 is positioned above the conveying path 17, while the platen 26 is positioned below the conveying path 17. The recording portion 24 includes a carriage 22 and a recording head 21.

Figure 3:
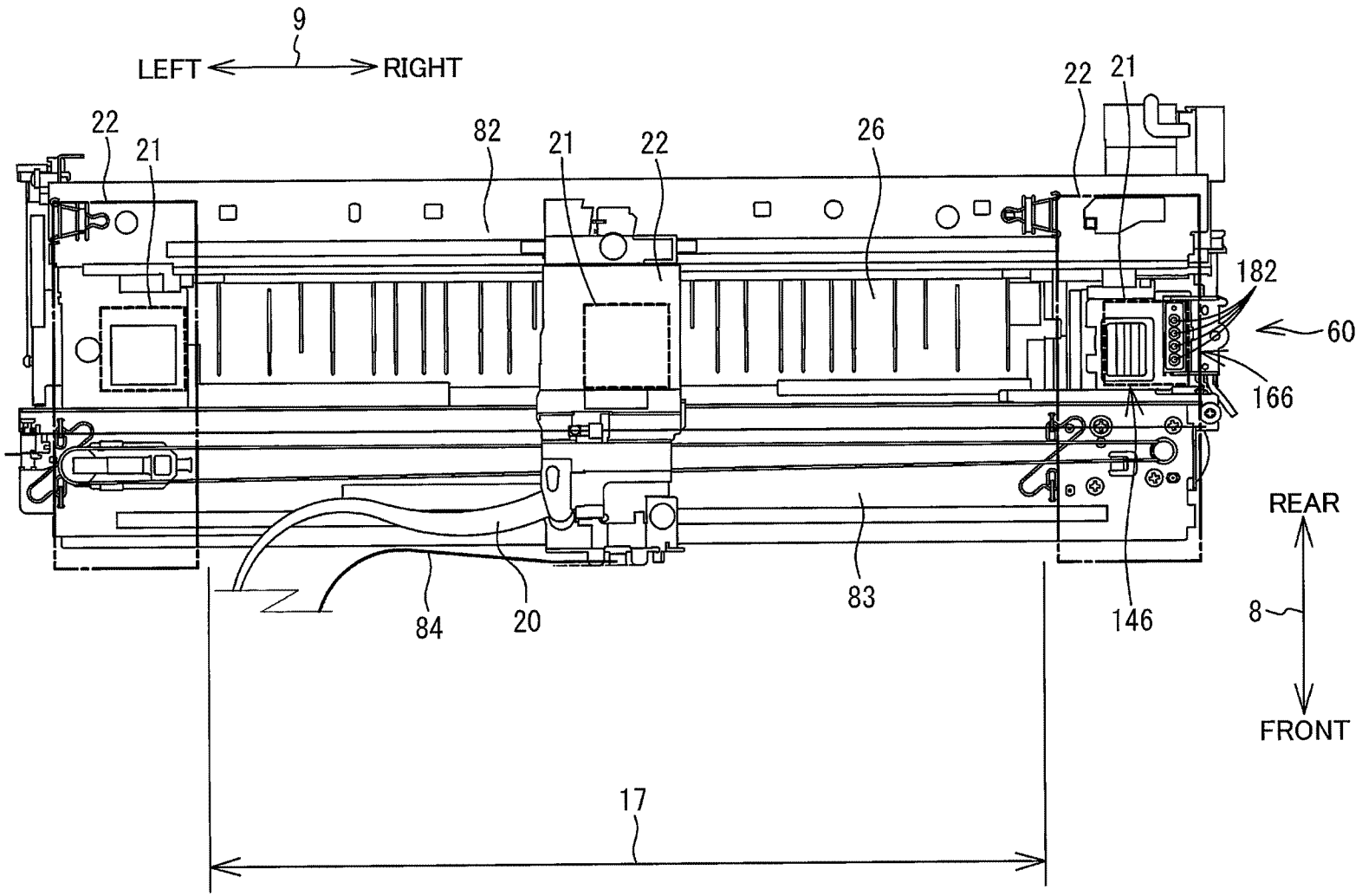
FIG. 3 is a plan view illustrating arrangement of a carriage 22 and a platen 26 in the multifunction peripheral 10 according to the embodiment.

As illustrated in FIG. 3, the carriage 22 is supported by guide rails 82 and 83. The guide rails 82 and 83 extend in the left-right direction 9 and are spaced apart from each other in the front-rear direction 8. The guide rails 82 and 83 are supported by a frame (not illustrated) of the printer portion 11. The carriage 22 is connected to a well-known belt mechanism provided at the guide rail 83. The belt mechanism is driven by a carriage-driving motor 173 (see FIG. 8). The carriage 22 connected to the belt mechanism is configured to make reciprocating movements in the left-right direction 9 in response to driving of the carriage-driving motor 173. The carriage 22 is configured to move within a range from a right side relative to a right end of the conveying path 17 to a left side relative to a left end of the conveying path 17, as indicated by alternate long and short dash lines in FIG. 3.

As illustrated in FIG. 3, a bundle of ink tubes 20 and a flexible flat cable 84 extend from the carriage 22.

The ink tubes 20 connect the case 101 (see FIG. 1B) to the recording head 21. Each of the ink tubes 20 is configured to supply ink stored in a corresponding ink cartridge 30 (an example of a cartridge) attached to the case 101 to the recording head 21. Four ink tubes 20 are provided in one-to-one correspondence with the respective ink cartridges 30 so that ink of respective four colors (black, magenta, cyan, and yellow) can flow through the corresponding internal spaces of the ink tubes 20. These four ink tubes 20 are bundled and connected to the carriage 22.

The flexible flat cable 84 is configured to establish electrical connection between a controller 130 (see FIG. 8) and the recording head 21. The flexible flat cable 84 is configured to transmit control signals outputted from the controller 130 to the recording head 21.

As illustrated in FIG. 2, the recording head 21 is mounted on the carriage 22. As illustrated in FIG. 9, the carriage 22 is formed with damper chambers 44 for temporarily storing ink supplied through the ink tubes 20. Here, one damper chamber 44 is provided corresponding to each of the ink of black, magenta, cyan, and yellow. That is, the carriage 22 is formed with four damper chambers 44 in the present embodiment. The recording head 21 is configured to eject the ink stored in the damper chambers 44 through a plurality of nozzles 29. Specifically, the controller 130 selectively applies a drive voltage to a plurality of piezoelectric elements 45 (see FIG. 8) provided corresponding to the plurality of nozzles 29, whereby the recording head 21 selectively ejects ink through the plurality of nozzles 29.

Note that, in FIG. 9, only one damper chamber 44 is illustrated, while the remaining three damper chambers 44 are omitted. In the following description and the drawings, only one damper chamber 44 is assumed to be provided unless otherwise specified.

The recording portion 24 is configured to be controlled by the controller 130. As the carriage 22 moves in the left-right direction 9, the recording head 21 ejects ink droplets, through the nozzles 29, toward the sheet 12 supported by the platen 26. In this way, an image is recorded on each sheet 12, and the ink stored in each of the ink cartridges 30 is consumed.

<Platen 26>

As illustrated in FIG. 2, the platen 26 is disposed between the conveying rollers 25 and the discharging rollers 27 at the conveying path 17. The platen 26 is arranged to oppose the recording portion 24 in the up-down direction 7, with the conveying path 17 interposed between the platen 26 and the recording portion 24. The platen 26 supports the sheet 12 conveyed by the conveying rollers 25 from below.

<Cover 87>

As illustrated in FIG. 1B, the front surface 14A of the casing 14 has a right end portion formed with an opening 85. Rearward of the opening 85, an accommodation space 86 is formed to accommodate the cartridge-attachment portion 110 therein. A cover 87 is assembled to the casing 14 so as to be capable of covering the opening 85. The cover 87 is pivotally movable, about a pivot axis 87A (pivot center) extending in the left-right direction 9, between a closed position (a position illustrated in FIG. 1A) for closing the opening 85 and an open position (a position illustrated in FIG. 1B) for exposing the opening 85.

<Case 101>

Figure 4:
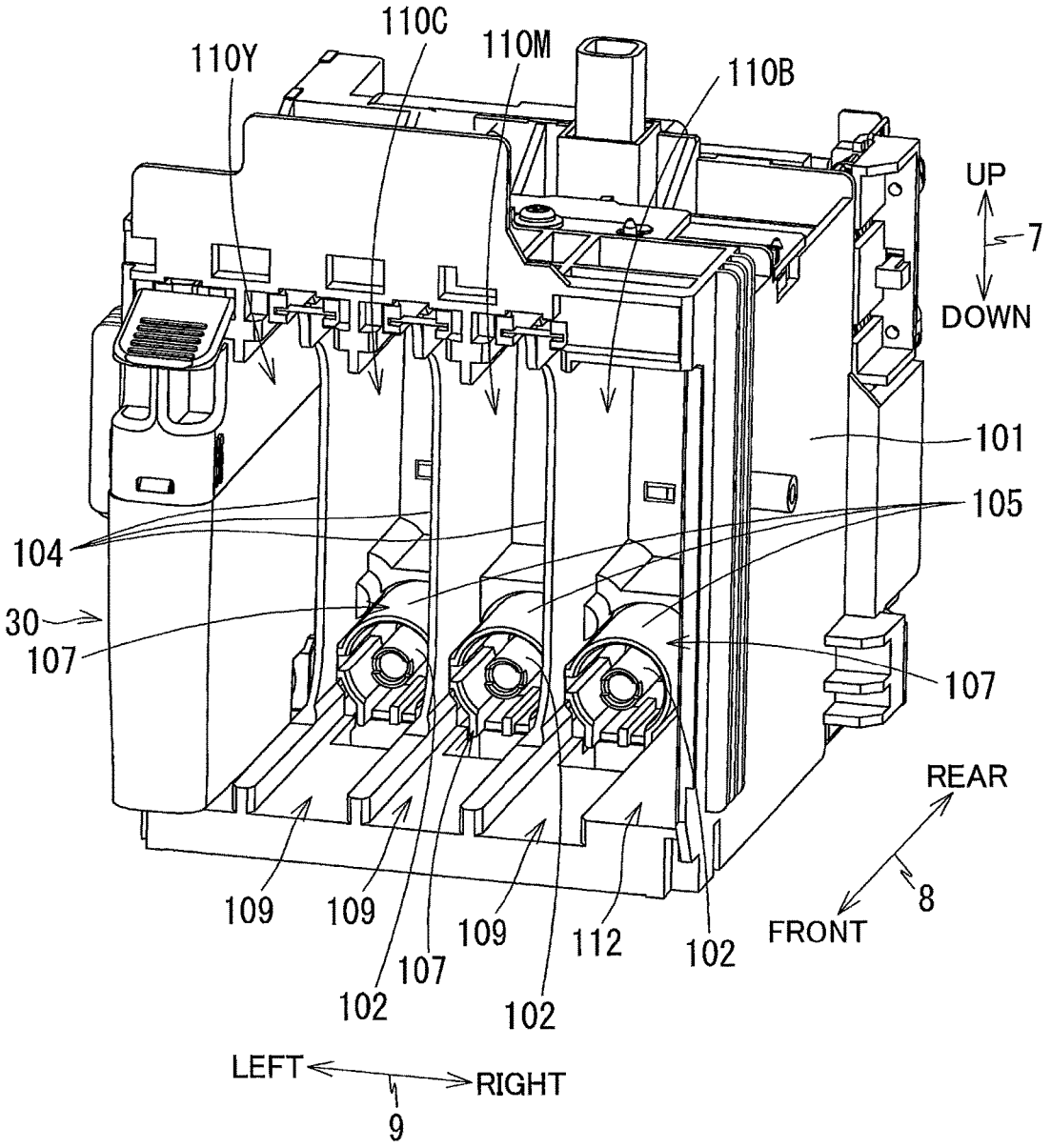
FIG. 4 is a perspective view illustrating an external appearance of a cartridge-attachment portion 110 of the multifunction peripheral 10 according to the embodiment as viewed from a side thereof at which an opening 112 is formed.
Figure 5:
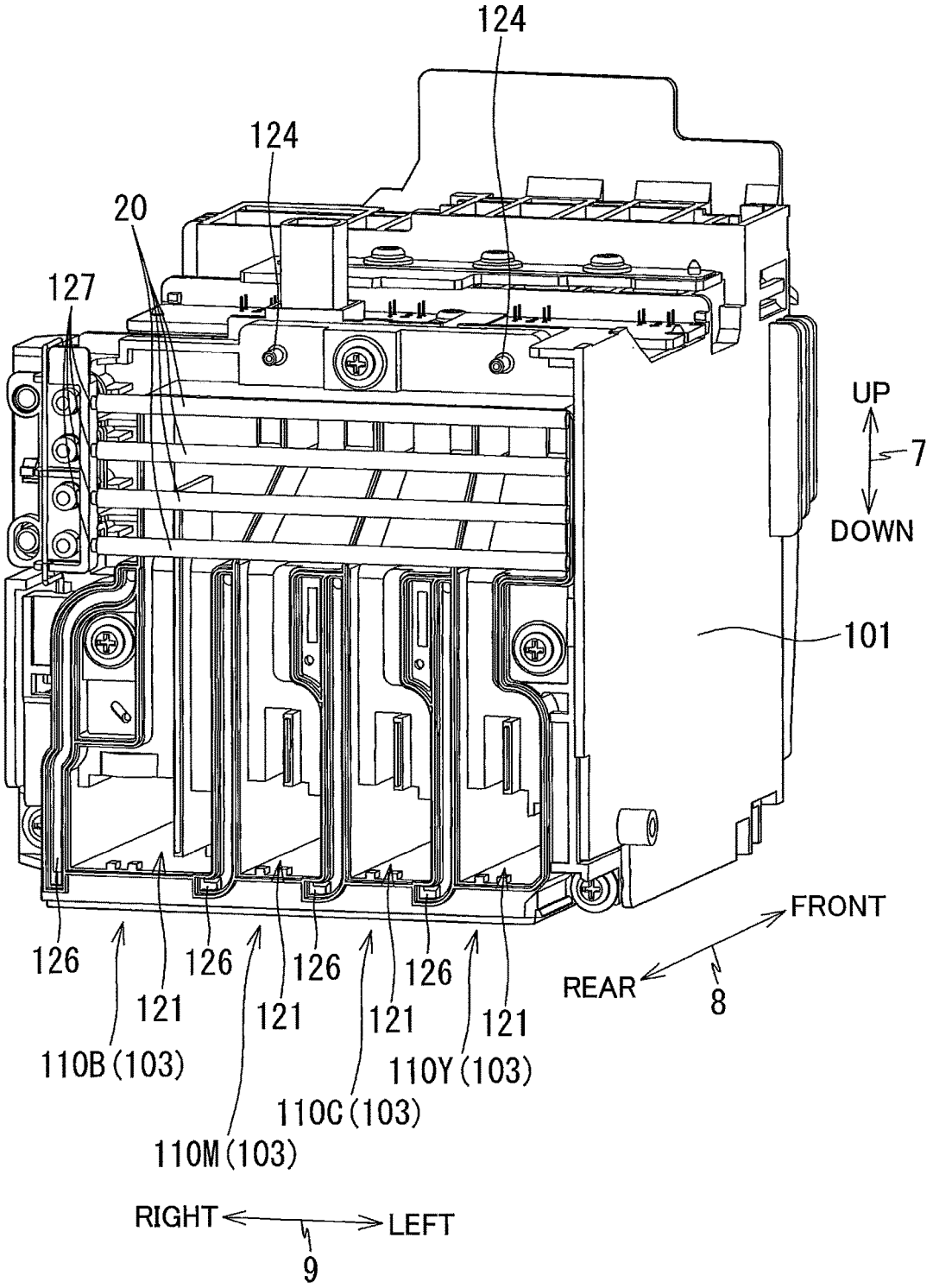
FIG. 5 is a perspective view illustrating the external appearance of the cartridge-attachment portion 110 as viewed from a side thereof at which tanks 103 are disposed.

As illustrated in FIGS. 4 and 5, the case 101 has a box-like shape defining an internal space therein. More specifically, the case 101 has a box-like shape having a top wall defining the top part of the internal space of the case 101, a bottom wall defining the bottom part of the internal space, a rear wall connecting the top wall to the bottom wall, and an opening 112 provided at a position facing the rear wall in the front-rear direction 8. The opening 112 can be exposed to the front surface 14A of the casing 14 that a user faces when using the multifunction peripheral 10.

The ink cartridges 30 can be inserted into and extracted from the case 101 through the opening 85 of the casing 14 and the opening 112 of the case 101. In the case 101, the bottom wall is formed with four guide grooves 109 for guiding insertion and extraction of the respective ink cartridges 30 in the front-rear direction 8 (see FIG. 4). Movements of the ink cartridges 30 in the front-rear direction 8 are guided by the corresponding guide grooves 109 as lower end portions of the ink cartridges 30 are inserted into the corresponding guide grooves 109. The case 101 is also provided with three plates 104 that partition the internal space of the case 101 into four individual spaces each elongated in the up-down direction 7. Each of the four spaces partitioned by the plates 104 is configured to receive one of the four ink cartridges 30.

The internal space of the case 101 configured to receive the ink cartridges 30 serves as cartridge-attachment portions 110. In the present embodiment, the cartridge-attachment portion 110 is provided corresponding to each of the four ink cartridges 30 storing black, magenta, cyan, and yellow. That is, in the present embodiment, the case 101 includes a cartridge-attachment portion 110B to which the ink cartridge 30 storing black ink is attached, a cartridge-attachment portion 110M to which the ink cartridge 30 storing magenta ink is attached, a cartridge-attachment portion 110C to which the ink cartridge 30 storing cyan ink is attached, and a cartridge-attachment portion 110Y to which the ink cartridge 30 storing yellow ink is attached.

As illustrated in FIG. 9, each of the cartridge-attachment portions 110 includes a connecting portion 107, a plurality of contacts 106, a rod 125, an attachment sensor 113 (an example of a sensor), and a tank 103. Each of the four cartridge-attachment portions 110 includes four contacts 106 for the corresponding ink cartridge 30. In other words, a total of 16 (sixteen) contacts 106 are provided for the four ink cartridges 30.

Note that, in FIG. 9, only one cartridge-attachment portion 110 is illustrated, and the remaining three cartridge-attachment portions 110 are omitted. Hereinafter, only one cartridge-attachment portion 110 is assumed to be provided unless otherwise specified.

The four cartridge-attachment portions 110 have the same configurations as each other, except that the cartridge-attachment portion 110B can receive the ink cartridge 30 having a capacity greater than capacities of the ink cartridges 30 configured to be attached to the cartridge-attachment portions 110M, 110C, and 110Y. Therefore, in the following description, configuration of one cartridge-attachment portion 110 will be described, while omitting description of configurations of the remaining three cartridge-attachment portions 110.

<Connecting Portion 107>

As illustrated in FIG. 4, the connecting portion 107 has an ink needle 102 and a guide portion 105.

The ink needle 102 is made of resin, and has a generally tubular shape. The ink needle 102 is disposed at a lower portion of the rear wall of the case 101. More specifically, the ink needle 102 is disposed on the rear wall of the case 101 at a position corresponding to an ink supply portion 34 (described later) of the ink cartridge 30 attached to the cartridge-attachment portion 110 (see FIG. 6). The ink needle 102 protrudes frontward from the rear wall of the case 101.

The guide portion 105 has a cylindrical shape, and is disposed at the rear wall of the case 101 to surround the ink needle 102. The guide portion 105 protrudes frontward from the rear wall of the case 101. A protruding end (front end) of the guide portion 105 is open. The ink needle 102 is positioned at a diametrical center of the guide portion 105. The guide portion 105 is so shaped that the ink supply portion 34 of the attached ink cartridge 30 is received in the guide portion 105.

The connecting portion 107 is not connected to the ink supply portion 34 of the ink cartridge 30 in a state where the ink cartridge 30 is not attached to the cartridge-attachment portion 110. On the other hand, during insertion of the ink cartridge 30 into the cartridge-attachment portion 110, that is, in the course of action for bringing the ink cartridge 30 into an attached position (i.e., a position illustrated in FIG. 6), the ink supply portion 34 of the ink cartridge 30 enters the guide portion 105. As the ink cartridge 30 is further inserted rearward into the cartridge-attachment portion 110, the ink needle 102 is inserted into an ink supply port 71 formed in the ink supply portion 34. As a result, the connecting portion 107 is connected to the ink supply portion 34. Hence, ink stored in a storage chamber 33 formed in the ink cartridge 30 is allowed to flow into the corresponding tank 103 through an ink valve chamber 35 formed in the ink supply portion 34 and an internal space 117 defined in the ink needle 102.

Incidentally, the ink needle 102 may have a flat-shaped tip end or a pointed tip end.

Figure 6:
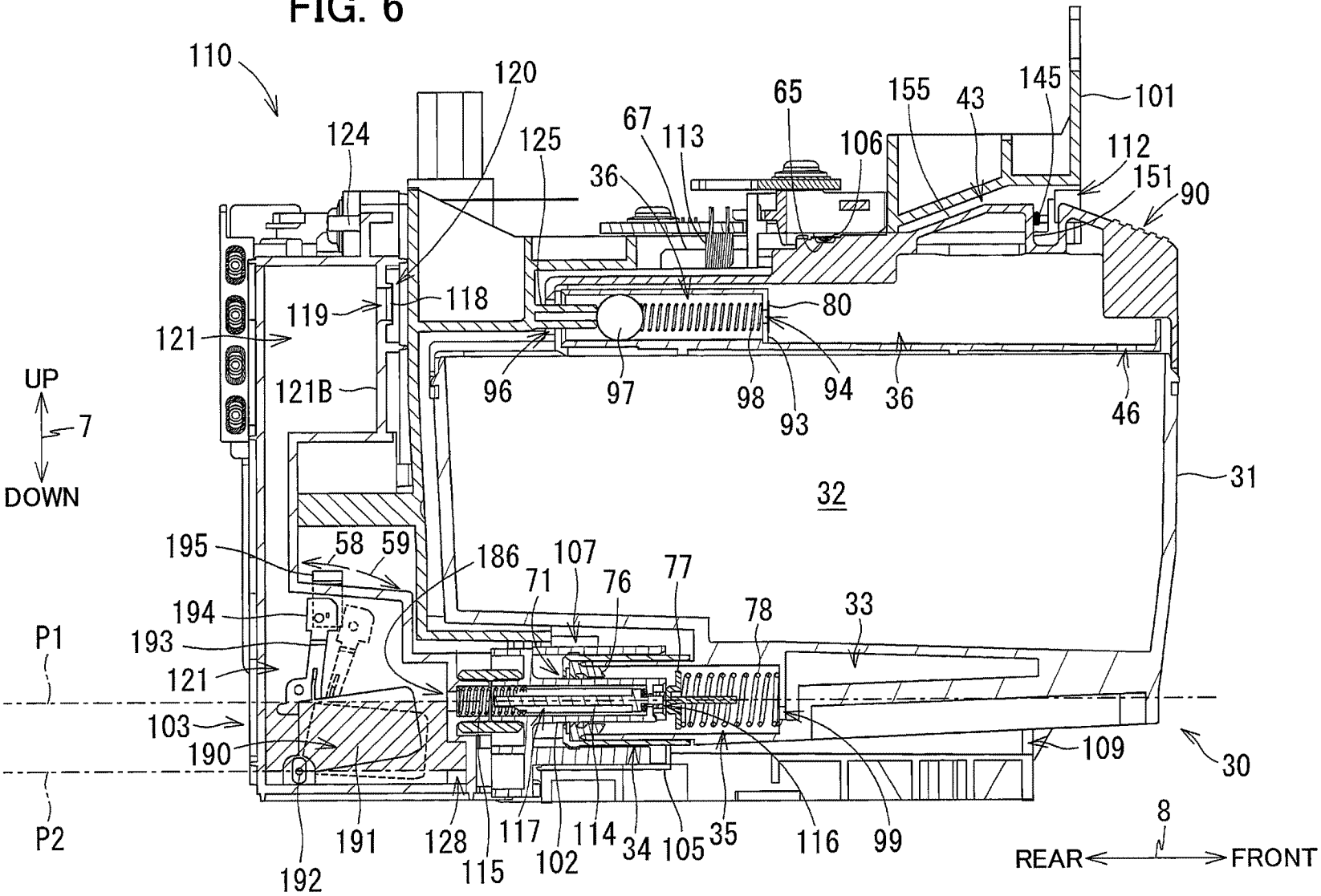
FIG. 6 is a cross-sectional view of the cartridge-attachment portion 110 and an ink cartridge 30 according to the embodiment, and illustrating a state where the ink cartridge 30 is attached to the cartridge-attachment portion 110.

As illustrated in FIG. 6, a valve 114 and a coil spring 115 are accommodated in the internal space 117 of the ink needle 102. The valve 114 is movable in the front-rear direction 8 to open and close an opening 116 formed in the protruding end of the ink needle 102. That is, the valve 114 is configured to open and close the internal space 117 of the ink needle 102. The coil spring 115 urges the valve 114 frontward. Accordingly, the valve 114 closes off the opening 116 in a state where no external force is applied to the valve 114 (i.e., in a state where the ink cartridge 30 is not attached to the cartridge-attachment portion 110). Further, a front end portion of the valve 114 urged by the coil spring 115 protrudes frontward relative to the opening 116 in a state where no external force is applied to the valve 114. In the process of connecting the connecting portion 107 to the ink supply portion 34, the valve 114 opens the opening 116. Details on how the valve 114 opens the opening 116 will be described later.

<Contacts 106>

As illustrated in FIG. 6, each of the four contacts 106 is provided on the upper wall of the case 101. Each of the four contacts 106 protrudes downward toward the internal space of the case 101 from the upper wall of the case 101. Although not illustrated in detail in the drawings, the four contacts 106 are arranged spaced apart from one another in the left-right direction 9. Each of the four contacts 106 is arranged at a position corresponding to each one of four electrodes 65 (described later) of the ink cartridge 30. Each contact 106 is made of a material having electrical conductivity and resiliency. The contacts 106 are therefore upwardly resiliently deformable. Note that the number of the contacts 106 and the number of electrodes 65 may be arbitrary.

Each contact 106 is electrically connected to the controller 130 (see FIG. 8) via an electrical circuit. When the contacts 106 are respectively engaged with the corresponding electrodes 65 and electrically connected thereto, a certain voltage Vc is applied to one of the electrodes 65, another one of the electrodes 65 is grounded, and electric power is supplied to still another one of the electrodes 65, for example. Due to establishment of the electrical connection between the contacts 106 and the corresponding electrodes 65, the controller 130 is allowed to access data stored in an IC of the corresponding ink cartridges 30. Outputs from the electrical circuits are configured to be inputted into the controller 130.

<Rod 125>

As illustrated in FIG. 6, the rod 125 is provided at the rear wall of the case 101 at a position above the ink needle 102. The rod 125 protrudes frontward from the rear wall of the case 101. The rod 125 has a cylindrical shape. The rod 125 is configured to be inserted into an air communication port 96 (described later) of the ink cartridge 30 in a state where the ink cartridge 30 is attached to the cartridge-attachment portion 110, that is, in a state where the ink cartridge 30 is in the attached position.

<Attachment Sensor 113>

As illustrated in FIG. 6, the attachment sensor 113 is also disposed at the upper wall of the case 101. The attachment sensor 113 is configured to detect whether or not the ink cartridge 30 is attached to the cartridge-attachment portion 110. The attachment sensor 113 is disposed at a position frontward of the rod 125 but rearward of the contacts 106. In the present embodiment, the attachment sensor 113 includes a light-emitting portion and a light-receiving portion. The light-emitting portion is positioned rightward or leftward relative to the light-receiving portion so as to be spaced apart therefrom in the left-right direction 9. When the ink cartridge 30 has been attached to the cartridge-attachment portion 110, a light-blocking plate 67 (described later) of the attached ink cartridge 30 is disposed between the light-emitting portion and the light-receiving portion of the attachment sensor 113. In other words, the light-emitting portion and the light-receiving portion are arranged to oppose each other, with the light-blocking plate 67 of the attached ink cartridge 30 interposed between the light-emitting portion and the light-receiving portion.

The attachment sensor 113 is configured to output different detection signals depending on whether or not light emitted from the light-emitting portion in the left-right direction 9 is received by the light-receiving portion. For example, the attachment sensor 113 is configured to output a low-level signal to the controller 130 (see FIG. 8) in case that the light-receiving portion does not receive the light emitted from the light-emitting portion (that is, when an intensity of the light received at the light-receiving portion is less than a predetermined intensity). In the present embodiment, the light-blocking plate 67 is disposed at a position between the light-emitting portion and the light-receiving portion of the attachment sensor 113 in a state where the ink cartridge 30 is attached to the cartridge-attachment portion 110, and therefore the attachment sensor 113 outputs a low-level signal to the controller 130.

On the other hand, the attachment sensor 113 is configured to output a high-level signal to the controller 130 in case that the light emitted from the light-emitting portion is received by the light-receiving portion (that is, when the intensity of the received light is equal to or greater than the predetermined intensity). In the present embodiment, since nothing is located between the light-emitting portion and the light-receiving portion in a state where the ink cartridge 30 is not attached to the cartridge-attachment portion 110, the attachment sensor 113 outputs a high-level signal to the controller 130.

<Lock Shaft 145>

As illustrated in FIG. 6, a lock shaft 145 extends in the left-right direction 9 at a position in the vicinity of the upper wall of the case 101 and in the vicinity of the opening 112. The lock shaft 145 is a bar-like member extending in the left-right direction 9. The lock shaft 145 is, for example, a metal column. The lock shaft 145 has left and right ends fixed to walls defining left and right ends of the case 101. The lock shaft 145 extends in the left-right direction 9 over the four spaces of the case 101 in which the four ink cartridges 30 can be respectively accommodated.

The lock shaft 145 is configured to hold each of the ink cartridges 30 attached to the cartridge-attachment portion 110 at the attached position. The ink cartridges 30 are respectively engaged with the lock shaft 145 in a state where the ink cartridges 30 are attached to the cartridge-attachment portions 110. The lock shaft 145 is configured to retain each ink cartridge 30 in the cartridge-attachment portion 110 against urging forces of coil springs 78 and 98 of the ink cartridge 30 that push the ink cartridge 30 frontward.

<Tanks 103>

As illustrated in FIGS. 5 and 6, the tank 103 is provided at a position rearward of the case 101. The tank 103 has a generally box shape formed with a storage chamber 121 therein.

The storage chamber 121 is communicated with the internal space 117 of the ink needle 102 at the front side thereof through a communication port 186, thereby allowing ink to flow out from the ink cartridge 30 attached to the cartridge-attachment portion 110 in which the storage chamber 121 is provided and to be stored in the storage chamber 121 through the ink needle 102. That is, ink is supplied from the ink cartridge 30 attached to the cartridge-attachment portion 110 to the storage chamber 121.

The storage chamber 121 is communicated with an ink passage 126 through a communication port 128 (an example of an outlet port). The communication port 128 is formed in a side wall defining a lower portion of the storage chamber 121. The communication port 128 is positioned below the communication port 186. Further, the communication port 128 is positioned below the corresponding damper chamber 44 of the carriage 22.

The ink passage 126 extends upward from the storage chamber 121 and is connected to an ink outlet port 127 (see FIG. 5). Each ink outlet port 127 is connected to the corresponding one of the ink tubes 20. With this configuration, ink stored in the storage chamber 121 is allowed to flow into the ink passage 126 through the communication port 128, and to be supplied to the damper chamber 44 of the carriage 22 through the corresponding ink passage 126 and ink tube 20. The ink passage 126 and the ink tube 20 are an example of an ink passage.

As illustrated in FIG. 6, the storage chamber 121 communicates with an air communication port 124 (see FIG. 5) provided upward of the tank 103. The storage chamber 121 is communicated with the air communication port 124 through a through-hole 119 formed in a front wall 121B defining a front end of an upper portion of the storage chamber 121 and an air flow path 120 (an example of a second air flow path). The through-hole 119 is sealed with a semi-permeable membrane 118. The air communication port 124 is open to the outside. With this configuration, the storage chamber 121 is open to the atmosphere.

Although a film constituting the rear wall of the tank 103 is not illustrated in FIG. 5, a film seals a rear portion of the storage chamber 121 and the ink passage 126 to serve as a rear wall thereof.

<Pivoting Member 190>

As illustrated in FIG. 6, a pivoting member 190 is disposed in the storage chamber 121 of each tank 103. The pivoting member 190 is supported by a support member (not illustrated) provided in the storage chamber 121 so as to be pivotally movable in directions indicated by arrows 58 and 59. The pivoting member 190 may be supported by a member different from the above-mentioned support member. For example, the pivoting member 190 may be supported by the wall of the case 101 that defines the storage chamber 121.

The pivoting member 190 includes a float 191, a shaft 192, an arm 193, and a detected portion 194. The float 191 constitutes a lower portion of the pivoting member 190. The float 191 is formed of a material having a specific gravity smaller than a specific gravity of ink stored in the storage chamber 121. The shaft 192 protrudes from a right surface and a left surface of the float 191 in the left-right direction 9. The shaft 192 has protruding ends inserted into holes formed in the support member. With this configuration, the pivoting member 190 is supported by the support member so as to be pivotally movable about an axis of the shaft 192.

The arm 193 protrudes substantially upward from the float 191. The detected portion 194 is provided at a protruding tip end portion of the arm 193. The detected portion 194 has a plate shape extending in the up-down direction 7 and the front-rear direction 8. The detected portion 194 is formed of a material capable of blocking light emitted from a light-emitting portion of a liquid-level sensor 195 (an example of a sensor, described later).

When liquid level of the ink stored in the storage chamber 121 is higher than a position P1 (an example of a predetermined position) in the up-down direction 7, the pivoting member 190 is pivotally moved in the direction of the arrow 58 due to buoyancy acting on the float 191. As a result, the pivoting member 190 is positioned at a detection position indicated by a solid line in FIG. 6. While a position of the position P1 in the up-down direction 7 is the same as a position of an axial center of the ink needle 102 (that is, the center of the communication port 186) in the up-down direction 7 in the present embodiment, the position P1 may be a position other than the position described above.

When the ink stored in the storage chamber 121 is consumed and the liquid level of the ink stored in the storage chamber 121 is lowered to a position equal to or lower than the position P1 in the up-down direction 7, the pivoting member 190 is pivotally moved in the direction of the arrow 59 following the liquid level of the ink stored in the storage chamber 121. As a result, the pivoting member 190 is positioned at a non-detection position indicated by a broken line in FIG. 6. That is, the pivoting member 190 is configured to change its posture depending on whether the liquid level of the ink stored in the storage chamber 121 is at the same position as the position P1 in the up-down direction 7.

<Liquid-Level Sensor 195>

Figure 8:
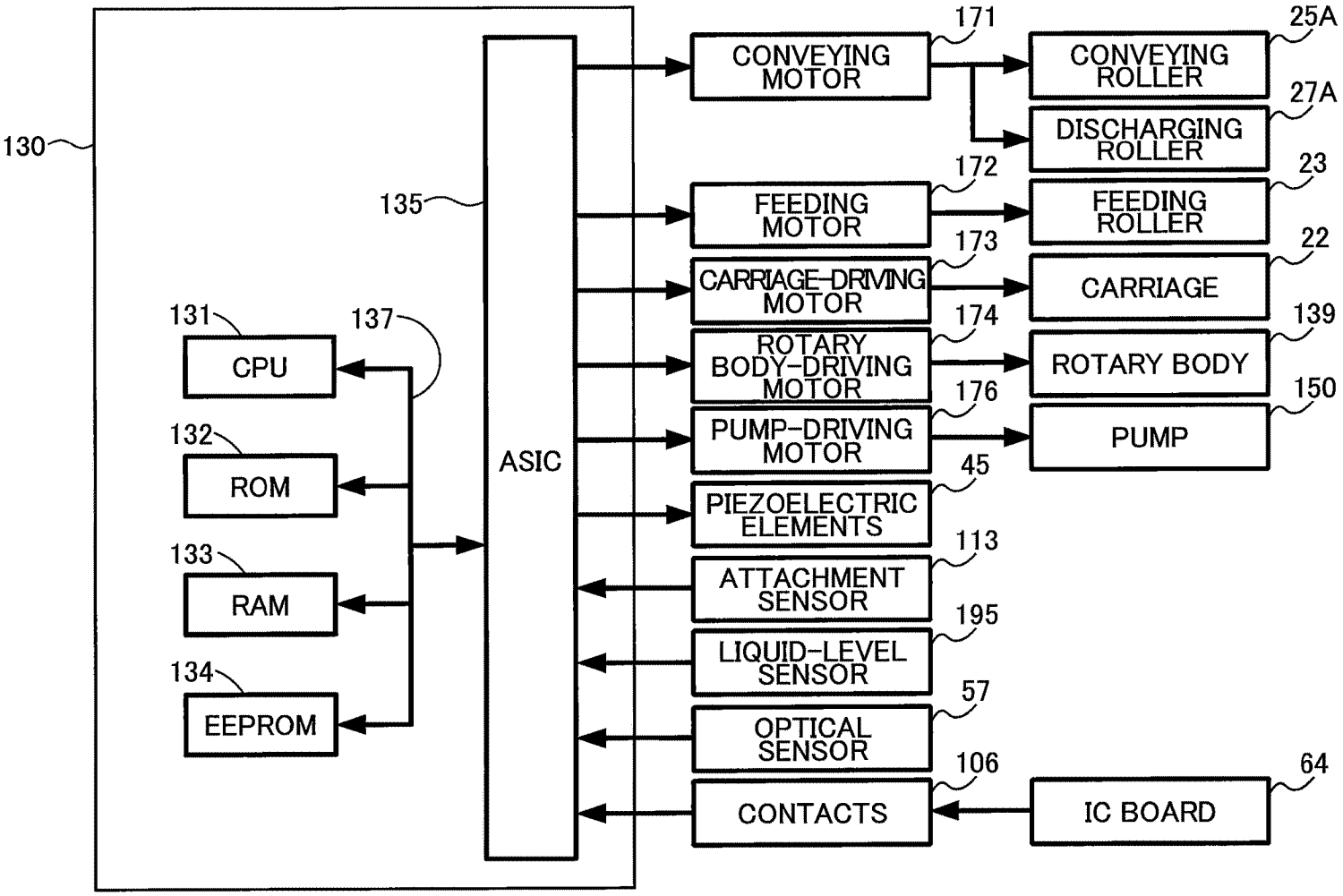
FIG. 8 is a block diagram illustrating a configuration of a controller 130 of the multifunction peripheral 10 according to the embodiment.
Figure 9:
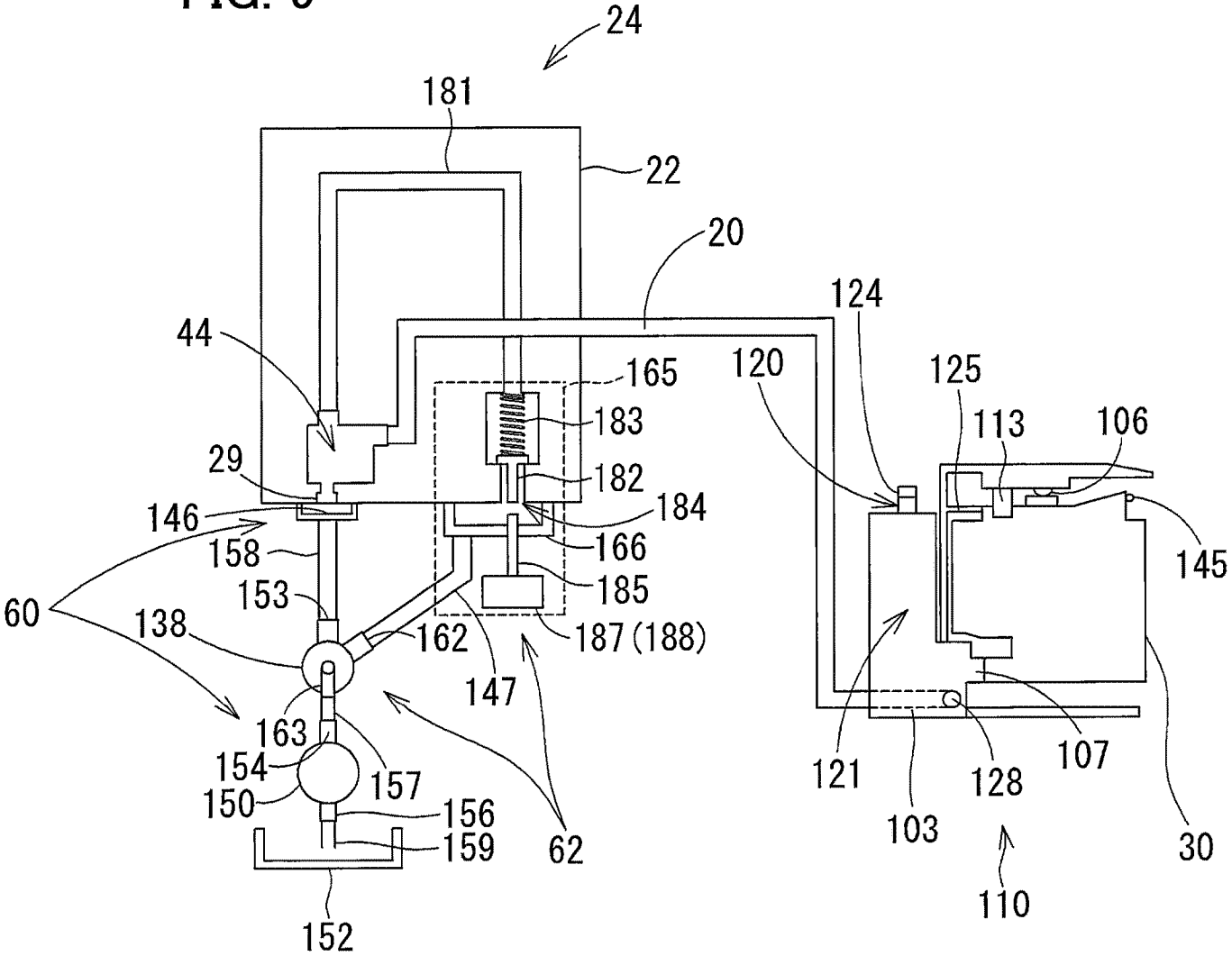
FIG. 9 is a cross-sectional view schematically illustrating the ink cartridge 30, the cartridge-attachment portion 110, a recording portion 24, and a switch mechanism 62 in the multifunction peripheral 10 according to the embodiment.

The liquid-level sensor 195 illustrated in FIGS. 6 and 8 is configured to detect the change in posture of the pivoting member 190 including the detected portion 194. In the present embodiment, the liquid-level sensor 195 includes the light-emitting portion and a light-receiving portion. The light-emitting portion and the light-receiving portion are arranged spaced apart from each other in the left-right direction 9 such that the storage chamber 121 of the tank 103 is interposed between the light-emitting portion and the light-receiving portion of the liquid-level sensor 195. The light-emitting portion of the liquid-level sensor 195 is disposed rightward or leftward relative to the storage chamber 121, while the light-receiving portion of the liquid-level sensor 195 is disposed at the other side of the light-emitting portion relative to the storage chamber 121. A path of light emitted from the light-emitting portion coincides with the left-right direction 9. When the pivoting member 190 is at the detection position, the detected portion 194 of the pivoting member 190 is positioned between the light-emitting portion and light-receiving portion of the liquid-level sensor 195. Of walls defining the storage chamber 121, at least a portion through which the light emitted from the light-emitting portion and travelling toward the right-receiving portion passes is formed of a material having light-transmissive property allowing light to pass therethrough.

The liquid-level sensor 195 is configured to output different detection signals depending on whether or not the light outputted from the light-emitting portion is received by the light-receiving portion. For example, the liquid-level sensor 195 is configured to output a low-level signal (a signal whose signal level is lower than a threshold level) to the controller 130 (see FIG. 8) in case that the light-receiving portion does not receive the light outputted from the light-emitting portion (that is, an intensity of the light received at the light-receiving portion is less than a predetermined intensity). On the other hand, the liquid-level sensor 195 is configured to output a high-level signal (a signal whose signal level is equal to or higher than the threshold level) to the controller 130 in case that the light-receiving portion receives the light outputted from the light-emitting portion (that is, the intensity of the light received at the light-receiving portion is equal to or higher than the predetermined intensity).

When the pivoting member 190 is positioned at the detection position, the detected portion 194 is positioned between the light-emitting portion and the light-receiving portion of the liquid-level sensor 195. Thus, in case that the liquid level of the ink stored in the storage chamber 121 of the tank 103 is higher the position P1 in the up-down direction 7, the light-receiving portion cannot receive the light outputted from the light-emitting portion, so that the liquid-level sensor 195 outputs a low-level signal to the controller 130.

On the other hand, when the pivoting member 190 is positioned at the non-detection position, the detected portion 194 is retracted from the position between the light-emitting portion and the light-receiving portion of the liquid-level sensor 195. Thus, in case that the liquid level of the ink stored in the storage chamber 121 is equal to or lower than the position P1 in the up-down direction 7, the light-receiving portion can receive the light outputted from the light-emitting portion, so that the liquid-level sensor 195 outputs a high-level signal to the controller 130. In this way, the liquid-level sensor 195 outputs a signal depending on the posture (state) of the detected portion 194 to the controller 130.

<Maintenance Mechanism 60>

Figure 11A:
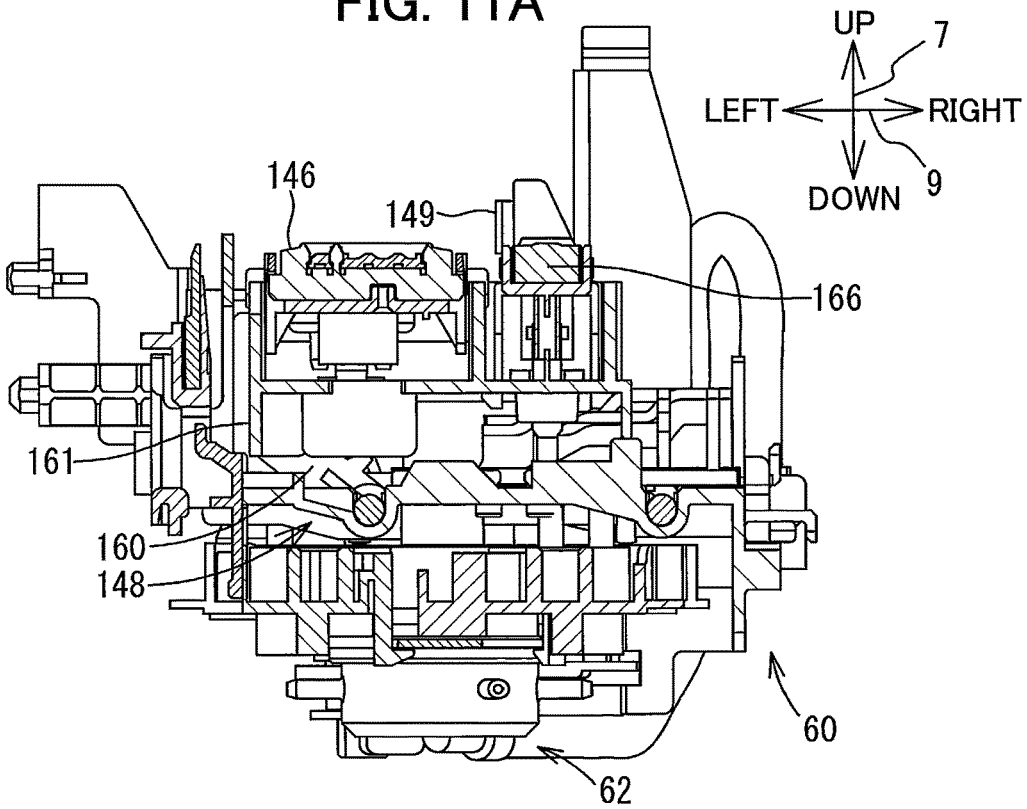
FIG. 11A is a cross-sectional view of a maintenance mechanism 60 of the multifunction peripheral 10 according to the embodiment, and illustrating a state where caps 146 and 166 are in an non-capping position.
Figure 11B:
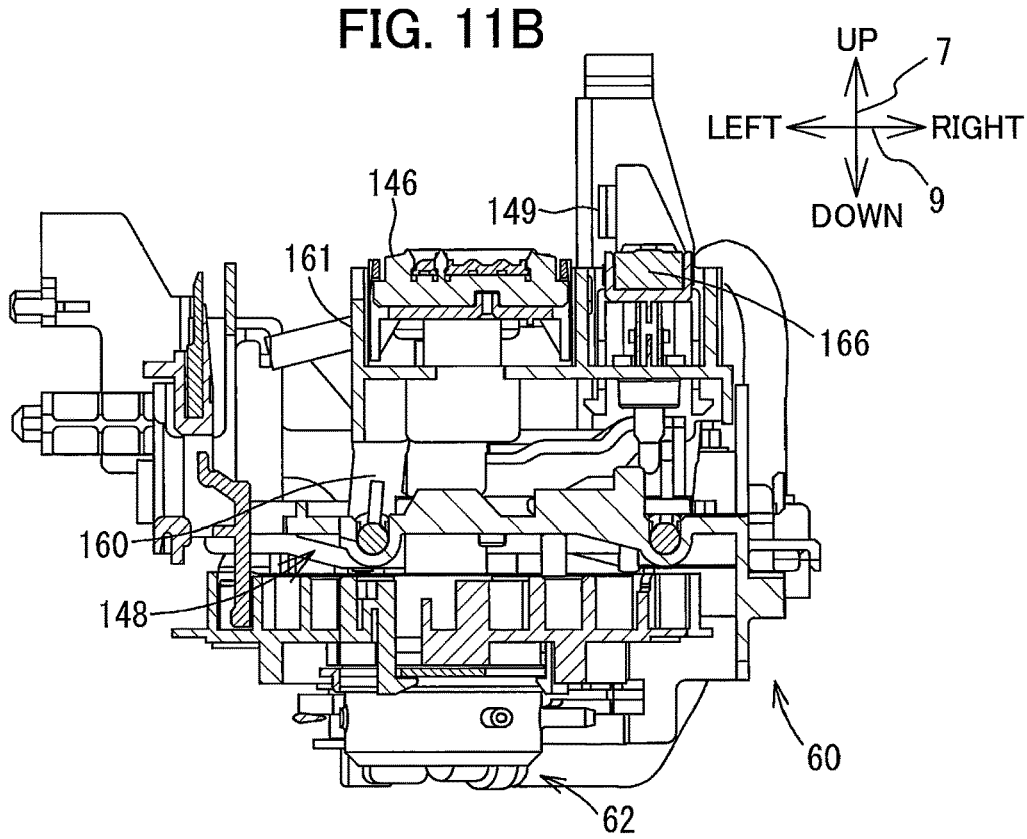
FIG. 11B is a cross-sectional view of the maintenance mechanism 60, and illustrating a state where the caps 146 and 166 are in a capping position.

The multifunction peripheral 10 further includes a maintenance mechanism 60 illustrated in FIGS. 9, 11A and 11B. As illustrated in FIG. 3, the maintenance mechanism 60 is disposed at a position rightward from an area (hereinafter, referred to as "passing area") where the sheets 12 are conveyed by the pair of conveying rollers 25 and the pair of discharging rollers 27. The recording head 21 and the sheets 12 supported by the platen 26 can oppose each other in the passing area.

As illustrated in FIGS. 11A and 11B, the maintenance mechanism 60 includes caps 146 and 166, a lift-up mechanism 148, an abutment lever 149, and a pump 150 (see FIG.

9). The maintenance mechanism 60 executes a purge operation to suck ink or air in the nozzles 29 and foreign matters adhering onto a nozzle surface (hereinafter, the mentioned ink, air, and foreign matters are collectively referred to as "ink and the like"), and an preliminary-suction operation to suck the ink and the like preliminarily ejected from the recording head 21 to the cap 146 to be ready for the printing process. The ink and the like sucked or removed by the maintenance mechanism 60 are configured to be stored in a waste liquid tank 152 (see FIG. 9).

The caps 146 and 166 are formed of rubber. The caps 146 and 166 are provided so as to face the carriage 22 when the carriage 22 has been moved to be positioned rightward of the passing area.

The caps 146 and 166 are movable between a capping position (a position illustrated in FIGS. 9 and 11B) where the caps 146 and 166 provide intimate contact with the recording head 21 and a non-capping position (a position illustrated in FIG. 11A) where the caps 146 and 166 are positioned lower than in the capping position and spaced apart from the recording head 21.

The cap 146 is configured to cover the nozzle surface (i.e., surface of the recording head 21 at which the nozzles 29 are formed) of the recording head 21 when the cap 146 is in the capping position. The cap 146 is configured to be separated from the nozzle surface when the cap 146 is in the non-capping position. The cap 146 is connected to a nozzle suction port 153 of a switch mechanism 62 (an example of a first switch) through a tube 158.

The cap 166 is configured to cover openings 184 (see FIG. 9) when the cap 166 is in the capping position. The cap 166 is configured to expose the opening 184 downward when the cap 166 is in the non-capping position. The cap 166 is connected to an exhaust port 162 of the switch mechanism 62 through a tube 147 of an exhaust unit 165 of the switch mechanism 62.

The lift-up mechanism 148 includes a link 160 as illustrated in FIGS. 11A and 11B. As the link 160 is pivotally moved interlocking with movement of the carriage 22, a holder 161 is movable between a position illustrated in FIG. 11A and a position illustrated in FIG. 11B. The holder 161 holds the caps 146, 166 and the abutment lever 149 protruding vertically upward. The abutment lever 149 extends up to a movable range of the carriage 22.

When the carriage 22 is moved to the position rightward of the passing area, the carriage 22 urges the abutment lever 149 to move the same rightward. The holder 161 holding the abutment lever 149 is moved upward interlocking with the rightward movement of the abutment lever 149 to move the caps 146 and 166 to the capping position. On the other hand, when the carriage 22 is moved leftward from a position rightward of the passing area, the carriage 22 separates from the abutment lever 149, whereby the abutment lever 149 is moved leftward. As a consequence, the holder 161 is moved downward interlocking with the leftward movement of the abutment lever 149 to move the caps 146 and 166 to the non-capping position.

<Pump 150>

The pump 150 illustrated in FIG. 9 is, for example, a rotary tube pump. The pump 150 is driven by a pump-driving motor 176 (see FIG. 8) to form a flow of fluid (ink, air, or the like) directed from a suction port 154 (see FIG. 9) toward a discharge port 156 (see FIG. 9). That is, the pump 150 is configured to exhaust fluid sucked through the suction port 154 through the discharge port 156. A tube 157 extending from the suction port 154 has a distal end connected to a pump port 163 of the switch mechanism 62. A tube 159 extending from the discharge port 156 has a distal end open to the atmosphere. The waste liquid tank 152 is disposed below the distal end of the tube 159. With this configuration, fluid discharged through the discharge port 156 is configured to flow into the waste liquid tank 152 through the tube 159.

Figure 12A:
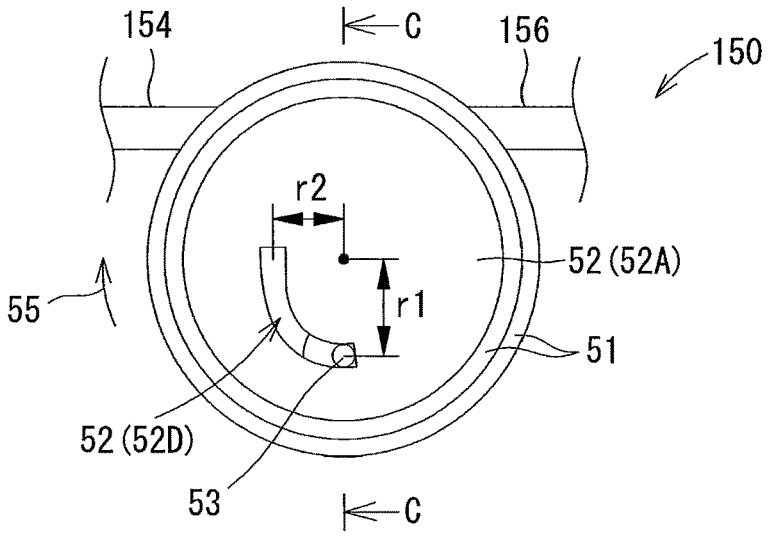
FIG. 12A is a schematic plan view of a pump 150 of the multifunction peripheral 10 according to the embodiment, and illustrating a state where a roller 53 is in a first position.
Figure 12B:
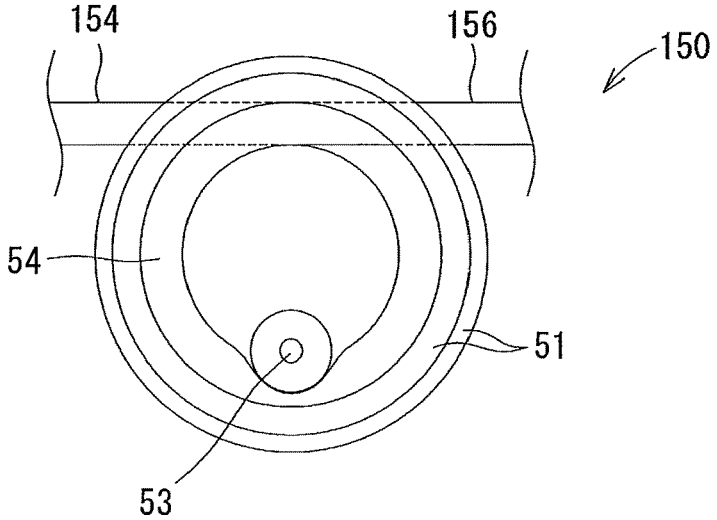
FIG. 12B is a schematic plan view of the pump 150, and illustrating a state where a rotary body 52 of the pump 150 is omitted from FIG. 12A.
Figure 12C:
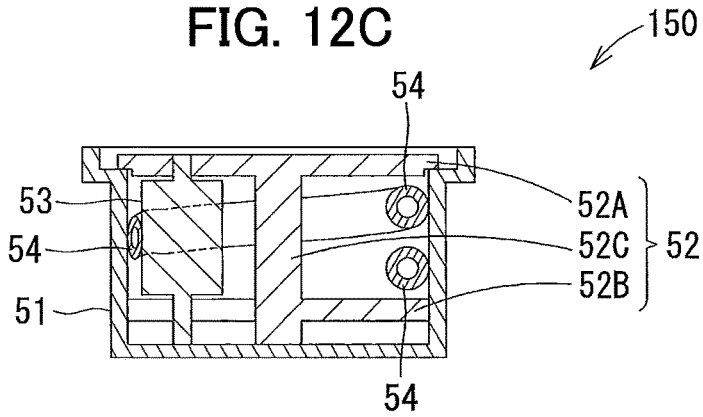
FIG. 12C is a cross-sectional view of FIG. 12A taken along a line C-C.

As illustrated in FIGS. 12A through 12C, the pump 150 includes a pump casing 51 defining an internal space therein, a rotary body 52 disposed within the internal space of the pump casing 51, a roller 53 (an example of a pressing member) movably supported by the rotary body 52, and a pump tube 54 (an example of a tube) disposed in the internal space of the pump casing 51.

The rotary body 52 is rotatable within the pump casing 51 due to driving of the pump-driving motor 176. The rotary body 52 includes a top plate 52A having a circular shape, a bottom plate 52B having a circular shape, and a connecting plate 52C connecting a center portion of the top plate 52A to a center portion of the bottom plate 52B.

The roller 53 is supported by the rotary body 52. Each of the top plate 52A and the bottom plate 52B is formed with a groove 52D. The grooves 52D of the top plate 52A and the bottom plate 52B substantially extend along a circumferential direction of the top plate 52A and the bottom plate 52B. The roller 53 has an upper end portion and a lower end portion respectively inserted into the grooves 52D of the top plate 52A and the bottom plate 52B. With this configuration, the roller 53 is movable along the grooves 52D. As illustrated in FIG. 12A, a distance r1 in a radial direction between a diametrical center of the top plate 52A and one end portion of the groove 52D is greater than a distance r2 in the radial direction between the diametrical center and another end portion of the groove 52D. The same is true with respect to the bottom plate 52B.

The pump tube 54 is disposed between an inner wall surface of the pump casing 51 and the roller 53 and extends along the circumferential direction of the top plate 52A and the bottom plate 52B. The pump tube 54 has one end in communication with the tube 157 through the suction port 154. The tube 157 is configured to be communicated with the damper chamber 44 through the switch mechanism 62. That is, the one end of the pump tube 54 can be communicated with the damper chamber 44. The pump tube 54 has another end connected to the tube 159 through the discharge port 156. That is, the other end of the pump tube 54 is communicated with the atmosphere.

As illustrated in FIG. 12A, upon receiving a driving force to make one of forward rotation and reverse rotation (in the present embodiment, forward rotation) from the pump-driving motor 176, the rotary body 52 is rotated in a direction indicated by an arrow 55, thereby moving the roller 53 relative to the grooves 52D to abut against the one end portions of the grooves 52D. Accordingly, the roller 53 urges the pump tube 54 radially outward (see FIGS. 12B and 12C). A position of the roller 53 illustrated in FIGS. 12A through 12C is an example of a first position. After this, the roller 53 is rotated together with the rotary body 52. As a result, the roller 53 is moved along the circumferential direction of the top plate 52A and the bottom plate 52B, i.e., along the extending direction of the pump tube 54. Thus, as the roller 53 is moved, the pump tube 54 is pressed by the roller 53, as illustrated in FIG. 12B and 12C. In this way, fluid in the pump tube 54 is pushed to move from the suction port 154 toward the discharge port 156. That is, the fluid is sucked from the suction port 154 toward the discharge port 156.

Figure 13A:
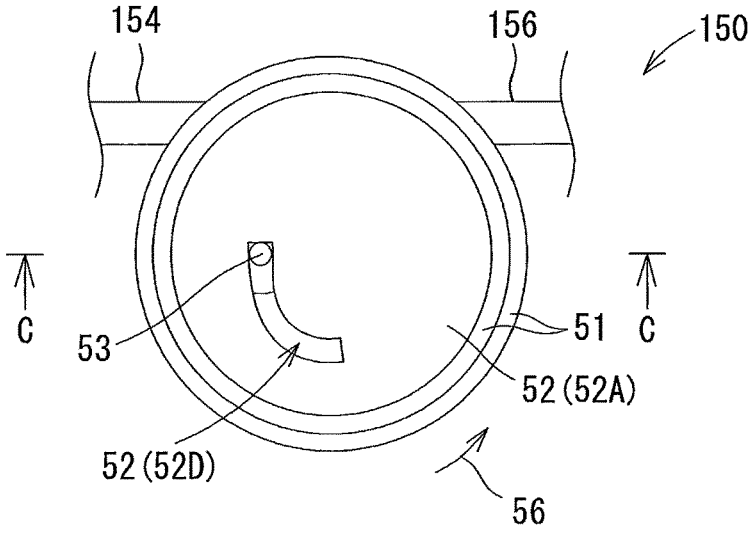
FIG. 13A is a schematic plan view of the pump 150, and illustrating a state where the roller 53 is in a second position.
Figure 13B:
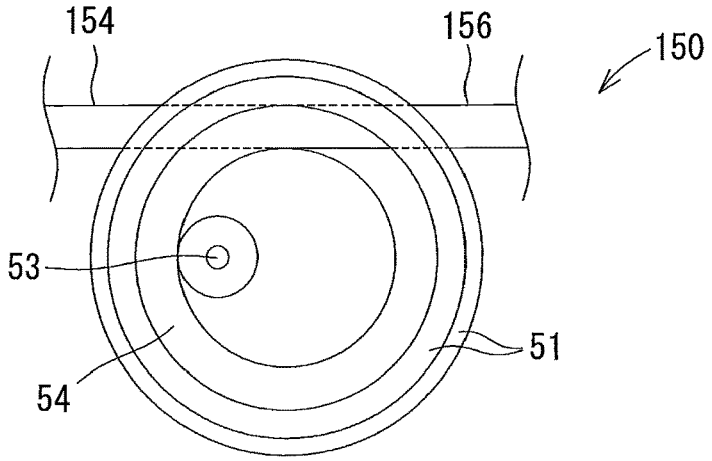
FIG. 13B is a schematic plan view of the pump 150, and illustrating a state where the rotary body 52 is omitted from FIG. 13A.
Figure 13C:
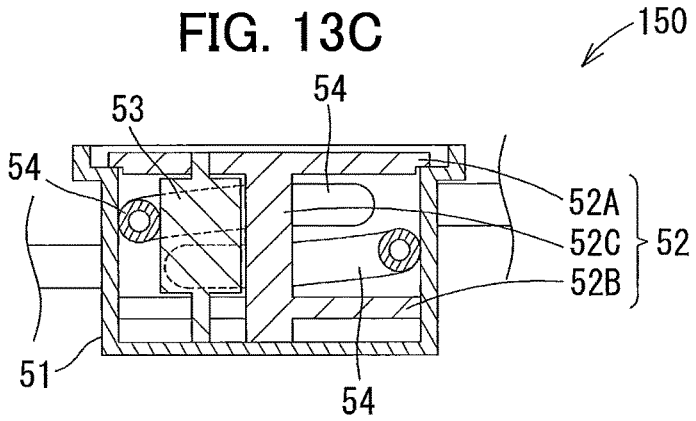
FIG. 13C is a cross-sectional view of FIG. 13A taken along a line C-C.

As illustrated in FIG. 13A, when the rotary body 52 receives a driving force to make remaining one of forward rotation and reverse rotation (in the present embodiment, the reverse rotation) from the pump-driving motor 176 to be rotated in a direction indicated by an arrow 56, the roller 53 is moved relative to the grooves 52D and abuts against the other end portions of the grooves 52D. At this time, the roller 53 is positioned radially inward of the pump tube 54 to separate therefrom. That is, the roller 53 does not press the pump tube 54 radially outward (see FIGS. 13B and 13C). A position of the roller 53 illustrated in FIGS. 13A through 13C is an example of a second position. That is, a pressing force of the roller 53 in the second position against the pump tube 54 is smaller than a pressing force of the roller 53 in the first position against the pump tube 54. As a result, the suction port 154 and the discharge port 156 are in communication with each other.

<Switch Mechanism 62>

As illustrated in FIG. 9, the multifunction peripheral 10 further includes the switch mechanism 62. The switch mechanism 62 is configured to switch a communication state between the damper chambers 44 and the suction port 154.

Figure 10A:
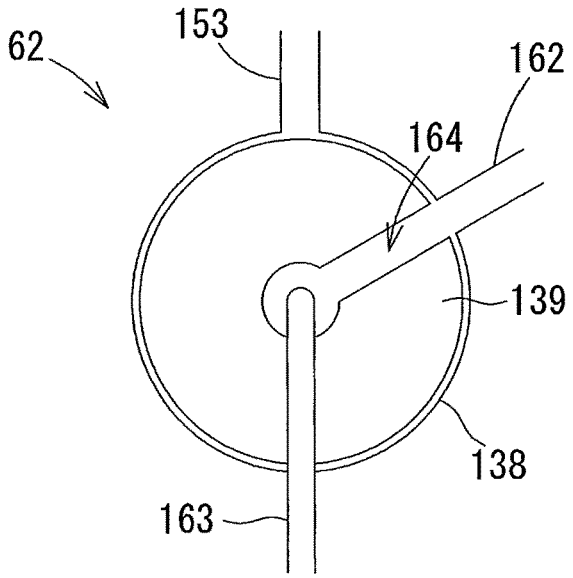
FIG. 10A is a schematic diagram of the switch mechanism 62, and illustrating a state where an exhaust port 162 is in communication with a pump port 163.
Figure 10B:
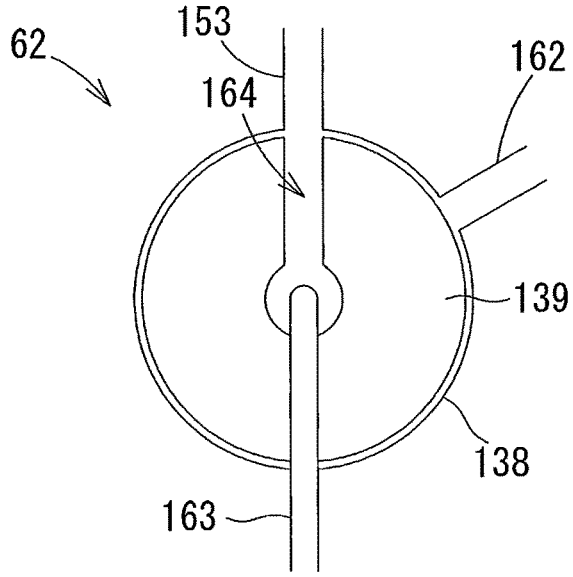
FIG. 10B is a schematic diagram of the switch mechanism 62, and illustrating a state where a nozzle suction port 153 is in communication with the pump port 163.

As illustrated in FIGS. 10A and 10B, the switch mechanism 62 includes a cylinder 138 having a substantially hollow cylindrical shape and a rotary body 139 having a columnar shape. The rotary body 139 is disposed in the cylinder 138.

The nozzle suction port 153, the exhaust port 162, and the pump port 163 are provided at the cylinder 138. The cylinder 138 and the rotary body 139 provide a space 164 therebetween. The space 164 is in communication with the pump port 163.

As illustrated in FIG. 9, the nozzle suction port 153 is in communication with the cap 146 of the maintenance mechanism 60 through the tube 158. The exhaust port 162 is in communication with the cap 166 through the tube 147 of the exhaust unit 165. The pump port 163 is in communication with the suction port 154 of the pump 150 through the tube 157.

The switch mechanism 62 includes the exhaust unit 165 (see FIG. 9). The exhaust unit 165 includes a flow path 181, the tube 147, a valve 182, a coil spring 183, an exhaust shaft 185, and a cam mechanism 187 (see FIG. 9).

The flow path 181 extends from the damper chamber 44 toward the cap 166. The flow path 181 has one end formed with the opening 184. The flow path 181 is communicated with the outside of the recording portion 24 through the opening 184. The opening 184 is configured to be covered by the cap 166 in the capping position.

The tube 147 has one end connected to the cap 166. In a state where the cap 166 is in the capping position, the tube 147 is in communication with the air flow path 181 through the cap 166 and the opening 184. The tube 147 has another end connected to the exhaust port 162 to be communicated therewith.

The valve 182 is disposed in the flow path 181. The valve 182 is movable in the up-down direction 7 between a closing position (position illustrated in FIG. 9) closing the opening 184, and an opening position that is higher than the closing position to open the opening 184.

The coil spring 183 is disposed in the flow path 181 and urges the valve 182 to the closing position.

The exhaust shaft 185 is positioned below the valve 182. The exhaust shaft 185 penetrates the cap 166 in the up-down direction 7. A gap provided between the exhaust shaft 185 and the cap 166 is closed, for example, by rubber. With this configuration, the exhaust shaft 185 and the cap 166 are movable in the up-down direction 7 relative to each other without generating gaps between the exhaust shaft 185 and the cap 166.

In the above description, only one flow path 181, valve 182, coil spring 183, and exhaust shaft 185 are assumed to be provided. However, in the present embodiment, although not illustrated in the drawings, the four flow paths 181, four valves 182, four coil springs 183, and four exhaust shafts 185 are provided corresponding to the four ink cartridges 30.

The cam mechanism 187 is configured to move the exhaust shafts 185 in the up-down direction 7 so that the valves 182 can open and close the corresponding openings 184. The cam mechanism 187 includes a cam follower 188 and a rotary cam (not illustrated).

The cam follower 188 is slidingly movable in the left-right direction 9 in accordance with rotation of the rotary cam to move the exhaust shafts 185 in the up-down direction 7. An upper surface of the cam follower 188 is formed with cam grooves (not illustrated) whose positions in the up-down direction 7 are continuously changed corresponding to the respective valves 182. Lower end portions of the exhaust shafts 185 are respectively fitted into the corresponding cam grooves of the cam follower 188. With this configuration, the exhaust shafts 185 are movable in the up-down direction 7 in accordance with the sliding movement of the cam follower 188.

As the exhaust shafts 185 are moved upward, the exhaust shafts 185 abut against the corresponding valves 182 to press the same upward. As a result, the valves 182 are moved to the opening position against the urging force of the corresponding coil springs 183.

As the exhaust shafts 185 are moved downward to separate from the corresponding valves 182, the valves 182 are moved to the closing position due to the urging force of the corresponding coil springs 183.

The rotary cam is integrally rotatable with the rotary body 139. The rotary cam has a cam groove whose diameter from a diametrical center of the rotary body 139 is continuously changed. A protrusion protruding from a lower surface of the cam follower 188 is fitted into the cam groove of the rotary cam. With this configuration, the cam follower 188 is slidingly movable in the left-right direction 9 in accordance with the rotation of the rotary cam (i.e., rotation of the rotary body 139). That is, the cam follower 188 is movable interlocking with movement (rotation) of the rotary body 139.

When the rotary body 139 receives driving power from a rotary body-driving motor 174 (see FIG. 8) to be rotated, connection states of the nozzle suction port 153 and the exhaust port 162 which are provided at the cylinder 138 with the pump port 163 is changed. Further, as the rotary body 139 receives driving power from the rotary body-driving motor 174 to be rotated, positions of the valves 182 are changed. In relation to the changes described above, a communication state between the damper chambers 44 and the suction port 154 is changed.

When the rotary body 139 is disposed at a position (rotational phase) illustrated in FIG. 10A, the exhaust port 162 is communicated with the pump port 163 (see FIGS. 9 and 12A) through the space 164 and is communicated with the suction port 154 (see FIG. 9) of the pump 150. Further, at this time, the valves 182 illustrated in FIG. 9 are in the opening position in the present embodiment. In this way, the damper chambers 44 are in communication with the suction port 154 through the exhaust unit 165 when the cap 166 is in the capping position.

When the rotary body 139 is disposed at a position (rotational phase) illustrated in FIG. 10B, the nozzle suction port 153 is communicated with the pump port 163 (see FIGS. 9 and 10A) through the space 164 to be communicated with the suction port 154 (see FIG. 9) of the pump 150. Further, at this time, the valves 182 illustrated in FIG. 9 are in the closing position in the present embodiment. As a result, the damper chambers 44 are in communication with the suction port 154 through the plurality of nozzles 29 when the cap 146 is in the capping position.

Further, the rotary body 52 of the pump 150 illustrated in FIGS. 12A through 12C constitutes the switch mechanism 62. As described above, the grooves 52D are formed in the rotary body 52, and the roller 53 is moved between the first position and the second position along the grooves 52D upon rotation of the rotary body 52. Stated differently, the switch mechanism 62 is configured to move the roller 53 between the first position and the second position.

When the rotary body 139 of the switch mechanism 62 is rotated to the position illustrated in FIG. 10A, and the rotary body 52 receives the driving power to make forward rotation from the pump-driving motor 176 to position the roller 53 in the first position (see FIGS. 12A through 12C), the switch mechanism 62 is in a suction state (an example of a first state) where the fluid in the damper chamber 44 can be sucked by the pump 150. In this suction state of the switch mechanism 62, when the driving force to make forward rotation from the pump-driving motor 176 is continuously received, the fluid in the damper chamber 44 is sucked toward the pump 150 through the exhaust unit 165.

When the rotary body 139 of the switch mechanism 62 is rotated to the position illustrated in FIG. 10A, and the driving force to make reverse rotation is applied to the rotary body 52 from the pump-driving motor 176 to position the roller 53 in the second position (see FIGS. 13A through 13C), the switch mechanism 62 is in an open state (an example of a second state) where the damper chambers 44 are open to the atmosphere.

In this way, the switch mechanism 62 can be switched between the open state and the suction state to change a communication state of the damper chambers 44 with the suction port 154. More specifically, when the switch mechanism 62 is in the suction state, the rotary body 139 is rotated to the position illustrated in FIG. 10A and the roller 53 is moved to the first position, thereby allowing the fluid in the damper chambers 44 to be sucked due to driving of the pump 150. On the other hand, when the switch mechanism 62 is in the open state, the rotary body 139 is rotated to the position illustrated in FIG. 10A and the roller 53 is moved to the second position, so that the damper chambers 44 are allowed to be fluidly communicated with the atmosphere.

<Optical Sensor 57>

The multifunction peripheral 10 further includes an optical sensor 57 (see FIG. 8). The optical sensor 57 is configured to detect a position (rotational phase) of the rotary body 139. The rotary body 139 includes a plurality of protruding portions (not illustrated) each protruding radially outward. The protruding portions are provided at positions different in phase in terms of rotation of the rotary body 139. The protruding portions are arranged spaced apart from each other by a predetermined angle of rotation of the rotary body 139.

The optical sensor 57 is disposed so as to face an outer periphery of the rotary body 139. When the optical sensor 57 and any one of the protruding portions oppose each other, the optical sensor 57 outputs a high-level signal to the controller 130 (see FIG. 8). On the other hand, when the optical sensor 57 and the protruding portions do not face each other, the optical sensor 57 outputs a low-level signal to the controller 130. As a sensor for detecting the position of the rotary body 139, various well-known sensors (for example, a proximity sensor) other than the optical sensor 57 may be employed.

<Ink Cartridge 30>

Figure 7:
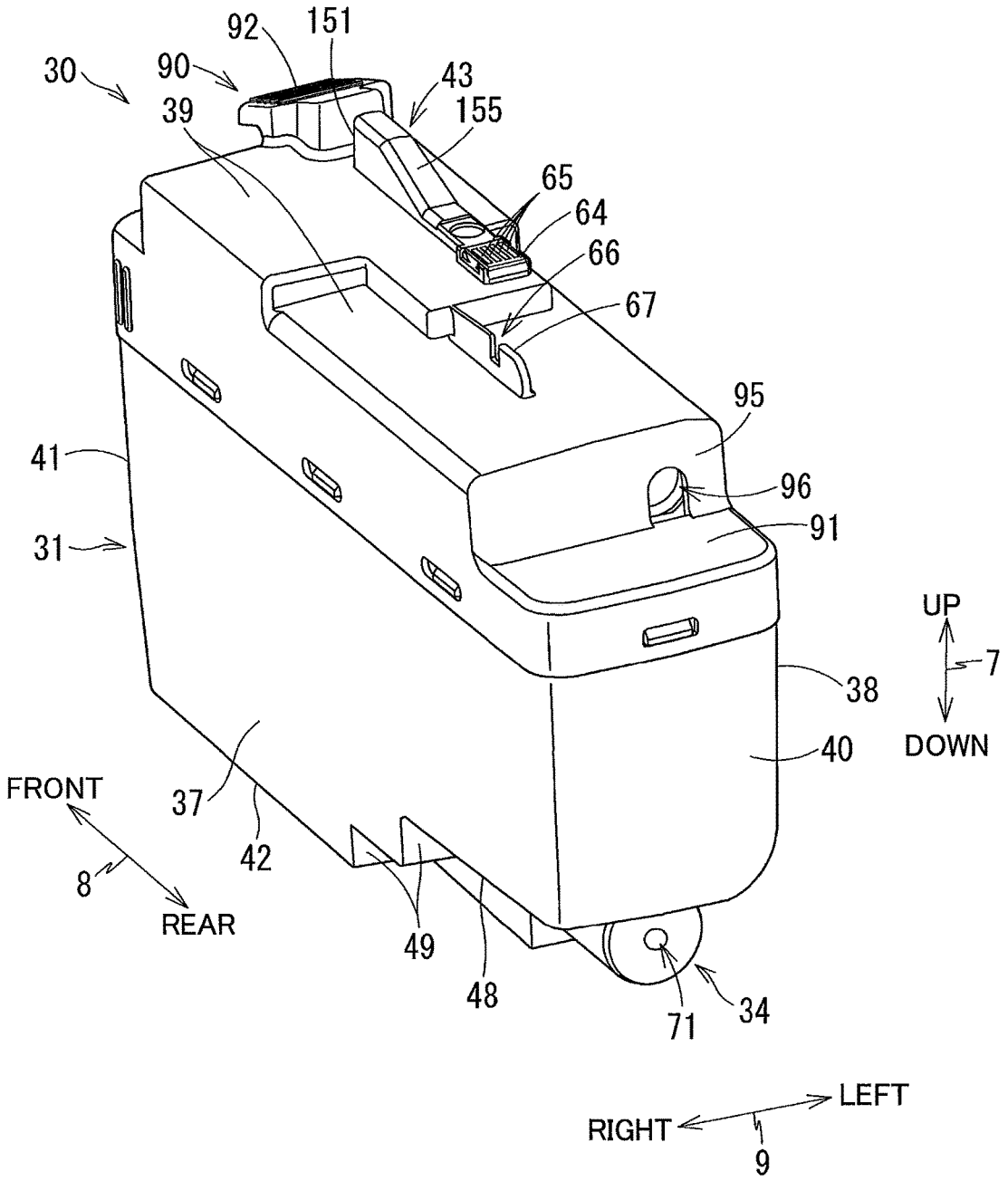
FIG. 7 is a perspective view of the ink cartridge 30 as viewed from a front side thereof.

The ink cartridge 30 illustrated in FIGS. 6 and 7 is a container for storing ink therein. The posture of the ink cartridge 30 illustrated in FIGS. 6 and 7 is an operable posture of the ink cartridge 30, that is, the posture of the ink cartridge 30 when the ink cartridge 30 is capable of being used in the multifunction peripheral 10.

As illustrated in FIGS. 6 and 7, the ink cartridge 30 includes a cartridge casing 31 that is substantially rectangular parallelepiped. As illustrated in FIG. 7, the cartridge casing 31 includes a rear wall 40, a front wall 41, a top wall 39, a bottom wall 42, a right side wall 37, and a left side wall 38.

The cartridge casing 31 as a whole has a generally flattened shape so that a dimension of the cartridge casing 31 in the left-right direction 9 is small, and a dimension of the cartridge casing 31 in the up-down direction 7 and a dimension of the cartridge casing 31 in the front-rear direction 8 are greater than the dimension of the cartridge casing 31 in the left-right direction 9. At least the front wall 41 of the cartridge casing 31 has light transmission capability so that the liquid level of the ink stored in a storage chamber 32 (described later) and the storage chamber 33 can be visually recognized from an outside of the cartridge casing 31.

The cartridge casing 31 includes a sub-bottom wall 48 positioned upward relative to the bottom wall 42 and extending frontward continuously from a lower end of the rear wall 40. In the present embodiment, a rear end of the sub-bottom wall 48 is positioned rearward relative to a rear end of the ink supply portion 34, while a front end of the sub-bottom wall 48 is positioned frontward relative to the rear end of the ink supply portion 34. A step wall 49 connects the bottom wall 42 to the sub-bottom wall 48. The ink supply portion 34 extends rearward from the step wall 49 at a position downward relative to the sub-bottom wall 48 and upward relative to the bottom wall 42. Incidentally, the rear end of the sub-bottom wall 48 may be positioned at an arbitrary position. For example, the rear end of the sub-bottom wall 48 may be positioned frontward relative to the rear end of the ink supply portion 34.

A protruding portion 43 is provided at an outer surface of the top wall 39 to protrude upward therefrom. The protruding portion 43 extends in the front-rear direction 8. The protruding portion 43 has a lock surface 151 facing frontward. The lock surface 151 is positioned upward relative to the top wall 39. The lock surface 151 is configured to contact the lock shaft 145 in a state where the ink cartridge 30 is attached to the cartridge-attachment portion 110. The lock surface 151 comes into contact with the lock shaft 145 while pushing the lock shaft 145 frontward, so that the ink cartridge 30 is held in the cartridge-attachment portion 110 against the urging forces of the coil springs 78 and 98.

The protruding portion 43 also has an inclined surface 155. The inclined surface 155 is positioned rearward relative to the lock surface 151. During an attachment process of the ink cartridge 30 to the cartridge-attachment portion 110, the lock shaft 145 is guided by the inclined surface 155. As the lock shaft 145 moves along the inclined surface 155, the lock shaft 145 is guided to a position capable of contacting the lock surface 151.

An operation portion 90 is disposed frontward relative to the lock surface 151 on the top wall 39. The operation portion 90 has an operation surface 92. When the operation surface 92 is pushed downward in a state where the ink cartridge 30 is attached to the cartridge-attachment portion 110, the ink cartridge 30 is pivotally moved, thereby moving the lock surface 151 downward. As a result, the lock surface 151 is positioned further downward relative to the lock shaft 145. In this way, the ink cartridge 30 can be extracted from the cartridge-attachment portion 110.

The light-blocking plate 67 is provided at the outer surface of the top wall 39 to protrude upward therefrom. The light-blocking plate 67 extends in the front-rear direction 8. The light-blocking plate 67 is disposed rearward relative to the protruding portion 43.

The light-blocking plate 67 is arranged to be located between the light-emitting portion and the light-receiving portion of the attachment sensor 113 in a state where the ink cartridge 30 is attached to the cartridge-attachment portion 110. Hence, the light-blocking plate 67 is configured to block the light of the attachment sensor 113 traveling in the left-right direction 9.

More specifically, when the light emitted from the light-emitting portion of the attachment sensor 113 is incident on the light-blocking plate 67 before the light arrives at the light-receiving portion of the attachment sensor 113, an intensity of the light received by the light-receiving portion is less than a predetermined intensity, for example, zero. Note that the light-blocking plate 67 may completely block the light traveling from the light-emitting portion to the light-receiving portion, or may partially attenuate the light. Alternatively, the light-blocking plate 67 may refract the light to change a traveling direction thereof, or may fully reflect the light.

In the present embodiment, a notch 66 is formed in the light-blocking plate 67. The notch 66 is a space that is recessed downward from an upper edge of the light-blocking plate 67, and extends in the front-rear direction 8. Since the notch 66 is formed in the light-blocking plate 67 at a position opposing the attachment sensor 113 in a state where the ink cartridge 30 is attached to the cartridge-attachment portion 110, the light emitted from the light-emitting portion of the attachment sensor 113 passes through the notch 66 and is therefore not blocked by the light-blocking plate 67. Accordingly, the light emitted from the light-emitting portion of the attachment sensor 113 reaches the light-receiving portion of the attachment sensor 113. On the other hand, in case that the notch 66 is not formed in the light-blocking plate 67, the light-blocking plate 67 opposes the light-emitting portion of the attachment sensor 113 in a state where the ink cartridge 30 is attached to the cartridge-attachment portion 110. Accordingly, the light emitted from the light-emitting portion of the attachment sensor 113 does not reach the light-receiving portion of the attachment sensor 113. With this configuration, types of the ink cartridges 30, such as types of ink stored in the ink cartridges 30, and initial amounts of ink stored in the ink cartridges 30, can be determined based on whether or not the notch 66 is formed in the light-blocking plate 67 of the ink cartridge 30 attached to the cartridge-attachment portion 110.

An IC board 64 is also provided at the outer surface of the top wall 39. The IC board 64 is positioned between the light-blocking plate 67 and the protruding portion 43 in the front-rear direction 8. The IC board 64 is electrically connected to the corresponding set of four contacts 106 in a state where the ink cartridge 30 is attached to the cartridge-attachment portion 110.

The IC board 64 includes a substrate made of silicon for example, an IC (not illustrated), and four electrodes 65. The IC and the four electrodes 65 are mounted on the substrate. The four electrodes 65 are arrayed in the left-right direction 9. The IC is a semiconductor integrated circuit. The IC readably stores data indicative of information on the ink cartridge 30, such as a lot number, a manufacturing date, a color of ink, and the like. Alternatively, the IC board 64 may be configured by providing the IC and electrodes on a flexible substrate having flexibility.

Each of the four electrodes 65 is electrically connected to the IC. Each of the four electrodes 65 extends in the front-rear direction 8. The electrodes 65 are arranged spaced apart from one another in the left-right direction 9. Each electrode 65 is provided on an upper surface of the IC board 64 and exposed thereon to an outside to allow electrical access to the electrode 65.

A step wall 95 facing rearward extends upward from a front end of a sub-top wall 91 that is positioned rearward relative to the top wall 39. The step wall 95 is formed with the air communication port 96 to allow the storage chamber 32 to communicate with the atmosphere. In other words, the air communication port 96 is positioned higher relative to the center of the cartridge casing 31 in the up-down direction 7. The air communication port 96 is a substantially circular-shaped opening formed in the step wall 95. The air communication port 96 has an inner diameter that is greater than an outer diameter of the rod 125 of the cartridge-attachment portion 110.

As illustrated in FIG. 6, in the attachment process of the ink cartridge 30 into the cartridge-attachment portion 110, the rod 125 enters an air valve chamber 36 (described later) through the air communication port 96. As the rod 125 passes through the air communication port 96, the rod 125 moves a valve 97 configured to seal the air communication port 96 frontward against the urging force of the coil spring 98. As the valve 97 is moved frontward to be separated from the air communication port 96, the storage chamber 32 is open to the atmosphere.

Incidentally, a member for sealing the air communication port 96 should not necessarily be the valve 97. For example, a peel-off seal may be provided at the step wall 95 to seal the air communication port 96.

As illustrated in FIG. 6, the cartridge casing 31 is formed with the storage chamber 32, the storage chamber 33, the ink valve chamber 35, and the air valve chamber 36. Each of the storage chamber 32, the storage chamber 33, and the ink valve chamber 35 is configured to store ink therein. The storage chamber 32, the storage chamber 33, and the ink valve chamber 35 are an example of a storage space. The air valve chamber 36 is configured to allow air to pass therethrough. The air valve chamber 36 is an example of a first air flow path. The storage chamber 32 and the storage chamber 33 are in communication with each other through a through-hole (not illustrated). The storage chamber 32 and the air valve chamber 36 are in communication with each other through a through-hole 46. The storage chamber 33 and the ink valve chamber 35 are in communication with each other through a through-hole 99 formed at a lower end portion of the storage chamber 33.

Within the air valve chamber 36, the valve 97 and the coil spring 98 are accommodated. The air valve chamber 36 is in communication with the outside through the air communication port 96. The valve 97 is movable between a closed position and an open position. At the closed position, the valve 97 seals the air communication port 96. At the open position, the valve 97 is separated from the air communication port 96. The coil spring 98 is disposed in the air valve chamber 36 so as to be capable of expanding and contracting in the front-rear direction 8. The coil spring 98 urges the valve 97 rearward, i.e., in a direction such that the valve 97 contacts the air communication port 96. The coil spring 98 has a spring constant that is smaller than a spring constant of the coil spring 78 of the ink supply portion 34.

A wall 93 partitioning the air valve chamber 36 is formed with a through-hole 94. The through-hole 94 is sealed with a semi-permeable membrane 80.

In the present embodiment, passage resistance of an air flow path configured to allow communication of the storage chamber 32 of the ink cartridge 30 with the atmosphere (i.e., the air valve chamber 36) is smaller than passage resistance of an air flow path configured to allow communication of the storage chamber 121 of each tank 103 with the atmosphere (i.e., the air flow path 120).

Conceivably, passage resistance can be made smaller by enlarging a cross-sectional area of a passage. Also, passage resistance can be increased by making a length of a passage longer, for example. Alternatively, passage resistance can be made either smaller or larger by changing types of a semi-permeable membrane that seals a passage. Still alternatively, passage resistance can become larger by increasing a number of semi-permeable membranes that may be provided in a passage.

Note that the passage resistance of the air flow path configured to allow communication of the storage chamber 32 of the ink cartridge 30 with the atmosphere may be equal to or greater than passage resistance of the air flow path configured to allow communication of the storage chamber 121 of each tank 103 with the atmosphere.

The ink supply portion 34 protrudes rearward from the step wall 49. The ink supply portion 34 has a cylindrical outer shape. The ink supply portion 34 has an inner space serving as the ink valve chamber 35. The ink supply portion 34 has a rear end portion that is open to the outside of the ink cartridge 30 through the ink supply port 71. A seal member 76 is provided at the rear end portion of the ink supply portion 34. The ink supply portion 34 has a front end that is in communication with the lower end portion of the storage chamber 33 through the through-hole 99 as described above. That is, the ink supply portion 34 is in communication with the lower end portion of the storage chamber 33.

A valve 77 and the coil spring 78 are accommodated in the ink valve chamber 35. The valve 77 is configured to move in the front-rear direction 8 to open and close the ink supply port 71 penetrating a center portion of the seal member 76. The coil spring 78 urges the valve 77 rearward. Accordingly, the valve 77 closes off the ink supply port 71 formed in the seal member 76 in a state where no external force is applied to the valve 77.

The seal member 76 is a disk-shaped member having a center portion formed with a through-hole. The seal member 76 is made of an elastic material such as rubber or elastomer, for example. A cylindrical inner peripheral surface defining the through-hole penetrating the center portion of the seal member 76 in the front-rear direction 8 defines the ink supply port 71. The ink supply port 71 has an inner diameter slightly smaller than an outer diameter of the ink needle 102.

As the ink cartridge 30 is attached to the cartridge-attachment portion 110 in a state where the valve 77 closes off the ink supply port 71 and the valve 114 closes the opening 116 of the ink needle 102, the ink needle 102 enters into the ink supply port 71 in the front-rear direction 8. That is, the connecting portion 107 and the ink supply portion 34 are connected to each other. At this time, the outer peripheral surface of the ink needle 102 provides liquid-tight contact with the inner peripheral surface of the seal member 76 that defines the ink supply port 71, while elastically deforming the seal member 76. As the tip end of the ink needle 102 passes through the seal member 76 and advances into the ink valve chamber 35, the tip end of the ink needle 102 abuts on the valve 77. As the ink cartridge 30 is further inserted into the cartridge-attachment portion 110, the ink needle 102 moves the valve 77 frontward against the urging force of the coil spring 78, thereby opening the ink supply port 71.

While the tip end of the ink needle 102 abuts on the valve 77, the valve 77 abuts on the valve 114 from a front side thereof and pushes the valve 114 rearward. Hence, the valve 114 moves rearward against the urging force of the coil spring 115, thereby opening the opening 116 of the ink needle 102. As a result, the ink stored in the storage chamber 32, the storage chamber 33 and the ink valve chamber 35 is allowed to flow into the storage chamber 121 of the corresponding tank 103 through the internal space 117 of the ink needle 102. Here, each of the storage chamber 32, the storage chamber 33, the ink valve chamber 35 and the storage chamber 121 is open to the atmosphere. Accordingly, the ink stored in the storage chamber 32, the storage chamber 33 and the ink valve chamber 35 of the ink cartridge 30 is supplied to the storage chamber 121 of the corresponding tank 103 through the ink supply portion 34 due to hydraulic head difference.

<Controller 130>

Next, an overall configuration of the controller 130 will be described with reference to FIG. 8.

The multifunction peripheral 10 includes the controller 130. The controller 130 is configured to control overall operations of the multifunction peripheral 10. The controller 130 includes a CPU 131, a ROM 132, a RAM 133, an EEPROM 134, an ASIC 135, and an internal bus 137 that connects these components to one another.

The ROM 132 stores programs and the like with which the CPU 131 controls various operations including an image-recording control operation. The RAM 133 is used as a storage area for temporarily storing data, signals, and the like used when the CPU 131 executes the programs. The EEPROM 134 stores settings, flags, and the like that need to be preserved after the multifunction peripheral 10 is turned off.

The conveying motor 171, the feeding motor 172, the carriage-driving motor 173, the rotary body-driving motor 174 for rotating the rotary body 139, and the pump-driving motor 176 for driving the pump 150 are connected to the ASIC 135. The ASIC 135 includes drive circuits for controlling these motors. When the CPU 131 inputs a drive signal for rotating each motor into a corresponding drive circuit thereof, a drive current corresponding to the drive signal is configured to be outputted from the drive circuit to the corresponding motor, thereby rotating the motor. In other words, the controller 130 is configured to control the motors 171, 172, 173, 174, and 176. That is, the controller 130 is configured to control the rotary body-driving motor 174 to control switch of the state of the switch mechanism 62. Further, the controller 130 is configured to control the pump-driving motor 176 to control driving of the pump 150.

Further, signals outputted from the attachment sensors 113 are inputted into the ASIC 135. When a low-level signal is inputted from each attachment sensor 113, the controller 130 determines that the ink cartridge 30 has been attached to the cartridge-attachment portion 110. On the other hand, when a high-level signal is inputted from each attachment sensor 113, the controller 130 determines that the ink cartridge 30 has not been attached to the cartridge-attachment portion 110.

Further, signals outputted from the liquid-level sensors 195 are inputted into the ASIC 135. When the liquid-level sensor 195 outputs a low-level signal to the controller 130, the controller 130 determines that the liquid level of ink stored in the storage chamber 121 of the tank 103 is higher than the position P1 in the up-down direction 7. On the other hand, when the liquid-level sensor 195 outputs a high-level signal to the controller 130, the controller 130 determines that the liquid level of ink stored in the storage chamber 121 of the tank 103 is equal to or lower than the positon P1 in the up-down direction 7.

Further, a signal outputted from the optical sensor 57 is inputted into the ASIC 135. The controller 130 is configured to receive the signal outputted from the optical sensor 57 (a high-level signal or a low-level signal) so that the controller 130 can determine the rotational phase of the rotary body 139.

Further, the piezoelectric elements 45 are also connected to the ASIC 135. The piezoelectric elements 45 are configured to operate upon receipt of electric power supplied by the controller 130 through a drive circuit (not illustrated). The controller 130 controls supply of electric power to the piezoelectric elements 45, thereby allowing ink droplets to be selectively ejected through the plurality of nozzles 29.

<Initial Ink Introduction Process>

Hereinafter, an initial ink introduction process will be described while referring to FIG. 14. After the ink cartridge 30 has been attached to the cartridge-attachment portion 110, the controller 130 executes initial ink introduction process to initially supply ink from the ink cartridge 30 to the storage chamber 121 in which ink has not been stored. Strictly speaking, a little amount of ink may remain in the storage chamber 121 due to the before-shipment test performed in a manufacturing company where test printing is performed by attaching an ink cartridge to a new multifunction peripheral to be shipped. The following description ignores such a little amount of ink remaining in the storage chamber 121 and treats the storage chamber 121 as being empty, i.e., ink as having not been stored in the storage chamber 121.

In the following description, only one tank 103 is assumed to be provided. However, the number of the tank 103 is arbitrary. For example, as described above, the four tanks 103 are provided in the present embodiment.

In a state prior to start of the initial ink introduction process (i.e., in an initial state of the multifunction peripheral 10), the ink cartridge 30 is not attached to the cartridge-attachment portion 110. Accordingly, each attachment sensor 113 outputs a high-level signal to the controller 130. Further, in the initial state of the multifunction peripheral 10, since no ink is stored in the storage chamber 121, the pivoting member 190 is positioned at the non-detection position, and therefore the liquid-level sensor 195 in each storage chamber 121 outputs a high-level signal to the controller 130. Further, in the initial state of the multifunction peripheral 10, the caps 146 and 166 are positioned at the capping position.

Figure 14:
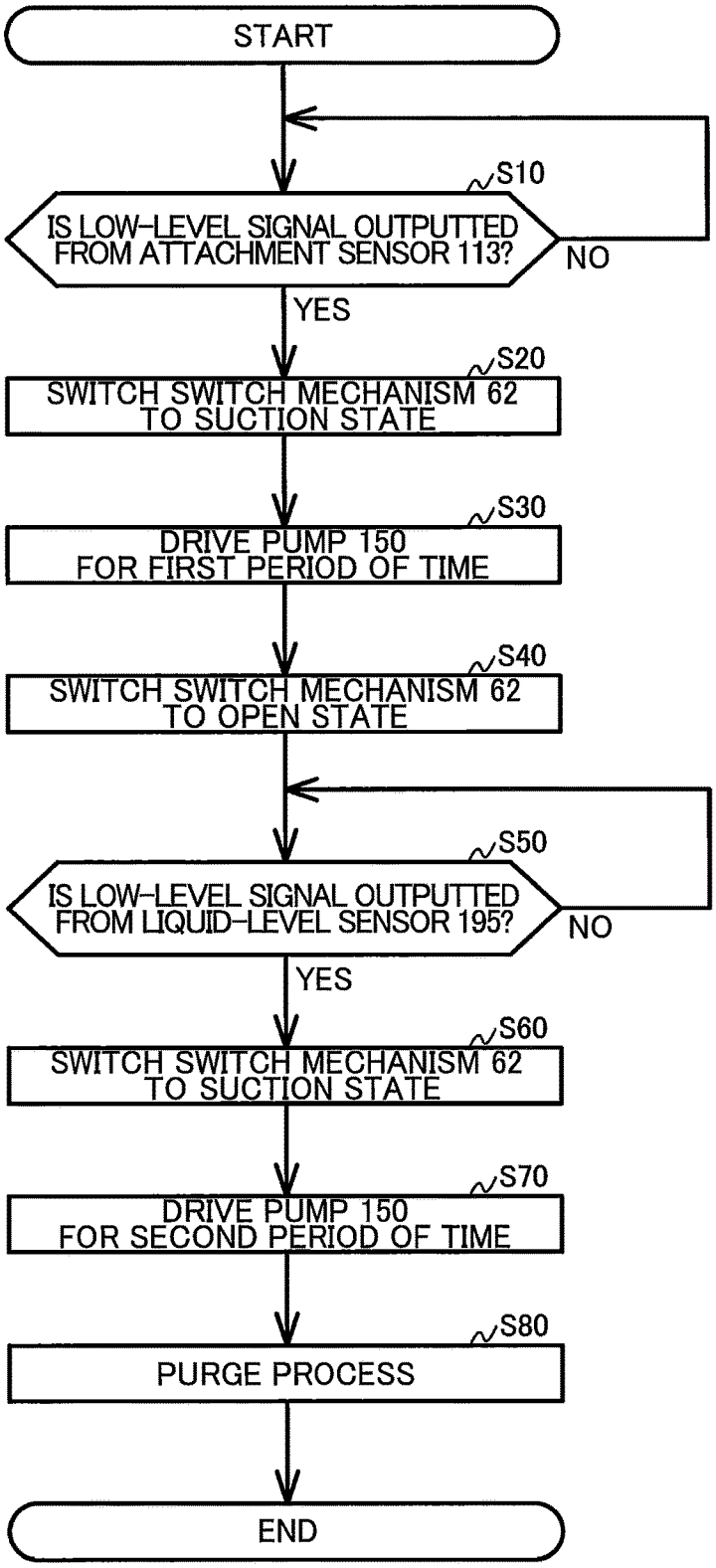
FIG. 14 is a flowchart illustrating steps in an initial ink introduction process executed by the controller 130.

In S10 at the beginning of the process illustrated in FIG. 14, the controller 130 determines the signals outputted from the attachment sensors 113. In other words, in S10 the controller 130 determines whether each attachment sensor 113 outputs a low-level signal or a high-level signal. When the signal outputted from each attachment sensor 113 remains a high-level signal (S10: NO), the controller 130 waits until the signal outputted from the attachment sensor 113 changes to a low-level signal.

When the signal outputted from the attachment sensor 113 is changed from a high-level to a low-level upon attachment of the ink cartridge 30 to the cartridge-attachment portion 110 (S10: YES), in S20 the controller 130 controls the rotary body-driving motor 174 to rotate the rotary body 139 to the position (rotational phase) illustrated in FIG. 10A. Simultaneously, the controller 130 controls the pump-driving motor 176 to make forward rotation to position the roller 53 at the first position. That is, in S20 the controller 130 switches the switch mechanism 62 to the suction state.

In a state where the ink cartridge 30 is attached to the cartridge-attachment portion 110, the ink cartridge 30 is open to the atmosphere through the air communication port 96, and the storage chamber 121 is open to the atmosphere through the air communication port 124. Thus, when the ink cartridge 30 has been completely received in the cartridge-attachment portion 110 in S10, ink stored in the ink cartridge 30 starts to be supplied to the storage chamber 121 due to hydraulic head difference.

Then, in S30 the controller 130 controls the pump-driving motor 176 to forwardly rotate for a first period of time. As a result, fluid in the damper chamber 44 of the carriage 22, the storage chamber 121 of the tank 103, and the ink cartridge 30 attached to the cartridge-attachment portion 110 those are communicated with the pump 150 is sucked toward the pump 150. Accordingly, ink stored in the ink cartridge 30 is supplied to the storage chamber 121. The ink supplied from the ink cartridges 30 to the storage chambers 121 is then supplied toward the damper chamber 44 through the communication port 128 and the ink tube 20. After the first period of time has elapsed, the driving of the pump 150 is stopped to interrupt supply of ink to the storage chamber 121.

Note that, when the liquid level of the ink stored in the storage chamber 121 reaches the same height as a position P2 (i.e., an upper end of the communication port 128, see FIG. 6) in the up-down direction 7 in S30, the communication port 128 is closed with ink. Accordingly, the ink supplied from the ink cartridge 30 starts flowing out of the storage chamber 121 through the communication port 128. Here, since an amount of ink that the pump 150 can suck is constant, an amount of ink sucked from the ink cartridge 30 by the pump 150 and an amount of ink flowing out through the communication port 128 by the pump 150 is approximately the same. That is, the ink sucked from the ink cartridge 30 to the storage chamber 121 after the liquid level of the ink in the storage chamber 121 becomes equal to or higher than the upper end of the communication port 128 is all sucked toward the damper chamber 44 through the communication port 128 and the ink tube 20. That is, during driving of the pump 150, the liquid level of ink in the storage chamber 121 cannot to be higher than the upper end of the communication port 128.

The first period of time is predetermined such that, the driving of the pump 150 for the first period of time allows the liquid level of the ink stored in the storage chamber 121 to reach the same height as the upper end of the communication port 128 (i.e., the position P2) in the up-down direction 7, for example. Further, in the present embodiment, the driving of pump 150 for the first period of time allows to realize the following two circumstances.

First, a volume of ink flowing out of the storage chamber 121 through the communication port 128 due to suction by the pump 150 for the first period of time is smaller than capacities of the ink passage 126 and the ink tube 20. Second, through the driving of the pump 150 for the first period of time, the volume of the ink flowing out of the storage chamber 121 through the communication port 128 due to suction by the pump 150 is smaller than a capacity of a portion in the storage chamber 121 higher than the position P2 (upper end of the communication port 128) and lower than the position P1 (that is, a hatched portion in FIG. 6) in the up-down direction 7. In other words, assuming that the storage chamber 121 is divided into three portions, specifically, an upper portion above the position P1, a lower portion below the position P2, and a remaining middle portion, the capacity of the middle portion is greater than the volume of the ink flowing into the ink passage 126 and the ink tube 20 during the first period of time.

In S30 ink flows out of the storage chamber 121 through the communication port 128 due to suction of the pump 150. However, since the volume of the ink sucked from the storage chamber 121 by the pump 150 is smaller than the capacities of the ink passage 126 and the ink tube 20, the flowing ink stays in the ink passage 126 and the ink tube 20 without reaching the damper chamber 44.

Further, since the volume of the sucked ink is smaller than the capacity of the storage chamber 121 ranging from the position P2 to the position P1 in the up-down direction 7, the liquid level of the ink stored in the storage chamber 121 cannot be higher than the position P1 in the up-down direction 7 even when the suction of the ink by the pump 150 for the first period of time is performed. Thus, the pivoting member 190 is maintained at the non-detection position, so that the liquid-level sensor 195 continues outputting a high-level signal to the controller 130.

Note that the driving of the pump 150 for the first period of time may not cause the above circumstances.

The process in S30 is an example of a first suction process.

Then, in S40 the controller 130 controls the pump-driving motor 176 to make reverse rotation to position the roller 53 at the second position (see FIGS. 13A through 13C). The rotary body 139 is maintained at the position illustrated in FIG. 10A. That is, the controller 130 switches the switch mechanism 62 to the open state.

As described above, the damper chamber 44 is positioned above the communication port 128. Thus, when the switch mechanism 62 is switched to the open state to thereby open the damper chamber 44 to the atmosphere, the ink remaining in the ink passage 126 and the ink tube 20 flows back into the storage chamber 121 through the communication port 128 due to the hydraulic head difference. That is, in S40, the storage chamber 121 is filled with ink supplied from the ink cartridge 30 as well as ink flowing back from the ink passage 126 and the ink tube 20.

The process in S40 is an example of an open process.

As the ink flows into the storage chamber 121, the liquid level of the ink stored in the storage chamber 121 becomes higher than the position P1 in the up-down direction 7. Accordingly, the pivoting member 190 is pivotally moved from the non-detection position to the detection position, thereby changing the posture of the detected portion 194. With the pivotal movement of the pivoting member 190, the signal outputted from the liquid-level sensor 195 is changed from a high-level to a low-level.

Here, subsequent to the process in S40, in S50 the controller 130 determines the signal outputted from the liquid-level sensor 195. Stated differently, in S50 the controller 130 determines whether the signal outputted from the liquid-level sensor 195 is a high-level or a low-level. When the liquid-level sensor 195 continues outputting a high-level signal to the controller 130 (S50: NO), the controller 130 waits until the signal outputted from the liquid-level sensor 195 changes to a low-level signal, i.e., the liquid level of the ink stored in the storage chamber 121 reaches the position P1. On the other hand, when the signal outputted from the liquid-level sensor 195 is changed from a high-level to a low-level (S50: YES), in S60 the controller 130 switches the switch mechanism 62 to the suction state as similar to the process in S20.

Then, in S70 the controller 130 controls the pump-driving motor 176 to make forward rotation for a second period of time. As a result, fluid in the damper chamber 44 in the carriage 22, the storage chamber 121 of the tank 103, and the ink cartridge 30 attached to the cartridge-attachment portion 110 those are communicated with the pump 150 is sucked toward the pump 150 again. Consequently, ink stored in the storage chamber 121 is supplied to the damper chamber 44 through the communication port 128 and the ink tube 20. After the second period of time has elapsed, the driving of the pump 150 is stopped, thereby interrupting supply of ink.

Through the driving of the pump 150 for the second period of time, the damper chamber 44 and the ink tube 20 are filled with ink stored in the ink chamber 121 at a time immediately before the process in S70 is executed.

The process in S60 and S70 are an example of a second suction process.

Finally, in S80 the controller 130 executes a purge process. That is, the controller 130 controls the rotary body-driving motor 174 to rotate the rotary body 139 to the position illustrated in FIG. 10B, and controls the pump-driving motor 176 to continuously make forward rotation (see FIGS. 12A through 12C). As a result, ink stored in the damper chamber 44 is sucked through the nozzles 29 of the recording head 21 to remove ink and air in the nozzles 29, and then discharged to the waste liquid tank 152 through the pump 150.

<Operational and Technical Advantages of the Embodiment>

According to the present embodiment, during the first suction process (S30), the ink stored in the ink cartridge 30 is initially supplied to the storage chamber 121, and the supplied ink is then supplied through the ink tube 20 toward the damper chamber 44 positioned above the storage chamber 121. At this time, since an amount of ink sufficient to close the storage chamber 121 has not been stored in the storage chamber 121, ink supplied from the storage chamber 121 into the ink tube 20 contains air bubbles.

Then, when the open process (S40) is executed, ink sucked into the ink tube 20 during the first suction process and containing air bubbles flows back into the storage chamber 121 of the tank 103 due to hydraulic head difference. As the ink remaining in the ink tube 20 flows into the storage chamber 121, the air bubbles contained in the ink is moved upward in the storage chamber 121. That is, air (air bubbles) and liquid (ink) are separated from each other. At a time of execution of the first suction process (S30), ink flowing into the ink tube 20 and the ink passage 126 due to the suction of the pump 150 is not appropriate to be ejected through the nozzles 29, since the ink contains air bubbles. However, through the process in S40, the ink can be made appropriate to be ejected through the nozzles 29.

Further, as the process in S40 is executed, the ink stored in the ink cartridge 30 is supplied to the storage chamber 121 of the tank 103 due to hydraulic head difference.

Since the ink once supplied into the ink tube 20 is allowed to flow back to the storage chamber 121, in S40 both of the ink in the ink tube 20 and the ink stored in the ink cartridge 30 flows into the storage chamber 121. Accordingly, ink can be supplied to the storage chamber 121 of the tank 103 in a shorter period of time than otherwise.

Further, according to the present embodiment, the volume of the ink flowing into the ink tube 20 and the ink passage 126 due to the driving of the pump 150 during the first suction process (S30) is smaller than the capacities of the ink passage 126 and the ink tube 20. Thus, ink containing air bubbles is sucked into the ink tube 20 and the ink passage 126 during the first suction process (S30), but this configuration can prevent the ink containing air bubbles from reaching the recording head 21.

Further, according to the present embodiment, the air flow path 120 provides the passage resistance greater than the passage resistance provided by the air valve chamber 36. Therefore, it takes a certain amount of time to supply ink from the ink cartridge 30 to the storage chamber 121 of the tank 103 due to the hydraulic head difference. However, with the above-described configuration and process executed by the controller 130, a period of time required for supplying ink to the storage chamber 121 of the tank 103 can be reduced.

In order for the switch mechanism 62 to have a function to switch the communication state of the damper chamber 44 with the suction port 154, it is conceivable to provide the switch mechanism 62 with two passages, namely, a passage for opening the damper chamber 44 to the atmosphere and a passage for connecting the damper chamber 44 to the pump 150. Here, in the present embodiment, the roller 53 of the pump 150 is movable between the first position and the second position, thereby enabling the switch mechanism 62 to be switched between the open state and the suction state. This configuration can change the communication state between the damper chamber 44 and the suction port 154 with only one passage. Therefore, according to the present embodiment, it is enough to provide the switch mechanism 62 with only one passage. Consequently, a simplified configuration of the switch mechanism 62 can be attained.

Further, according to the above-described configuration, a portion of the storage chamber 121 ranging from a position higher than the position P2 to a position lower than the position P1 in the up-down direction 7 has a capacity greater than the volume of the ink flowing into the ink tube 20 and the ink passage 126 during the first suction process (S30). Thus, even when the ink in the ink passage 126 and the ink tube 20 flows back into the storage chamber 121 in the open process (S40), the liquid level of ink in the storage chamber 121 does not become higher than the position P1, and therefore the state of the detected portion 194 is not changed. This configuration can prevent the process in S70 from being executed at an unexpected timing.

Further, according to the present embodiment, the controller 130 executes the first suction process (S30) at a timing when ink starts to flow from the ink cartridge 30 attached to the cartridge-attachment portion 110 to the storage chamber 121 of the tank 103 due to hydraulic head difference. As a result, ink can be supplied from the ink cartridge 30 to the storage chamber 121 of the tank 103 in a short time.

First Modification

In the above-described embodiment, the pump 150 includes the roller 53 movable relative to the rotary body 52. When the roller 53 is positioned at the first position, the pump 150 is enabled to suck the ink stored in the storage chamber 121 and the ink stored in the damper chamber 44, whereas when the roller 53 is positioned at the second position, the pump 150 allows the storage chamber 121 and the damper chamber 44 to be open to the atmosphere. However, the storage chamber 121 and the damper chamber 44 may be open to the atmosphere without using the pump 150.

As an example, a switch mechanism 262 according to a first modification of the embodiment will be described with reference to FIGS. 15 through 15C, wherein like parts and components are designated by the same reference numerals as those shown in the embodiment to avoid duplicating description.

The switch mechanism 262 includes a cylinder 238 and a rotary body 239. In addition to the nozzle suction port 153, the exhaust port 162, and the pump port 163, an air port 167 communicated with the atmosphere is provided at the cylinder 238. Further, the cylinder 238 and the rotary body 239 provide two spaces 164A and 164B therebetween. Spaces 164A and 164B are in communication with the pump port 163.

Figure 15A:
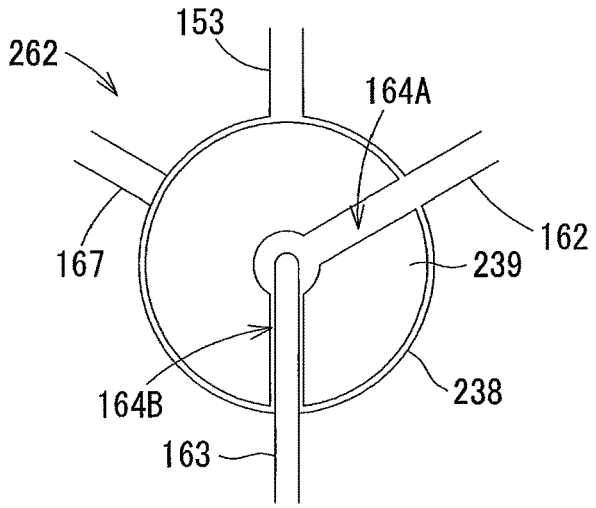
FIG. 15A is a schematic diagram of a switch mechanism 62 in the multifunction peripheral 10 according to a first modification, and illustrating a state where an exhaust port 162 is in communication with a pump port 163.

When the rotary body 239 is at the position (rotational phase) illustrated in FIG. 15A, the exhaust port 162 is communicated with the suction port 154 as similar to the state in FIG. 10A.

Figure 15B:
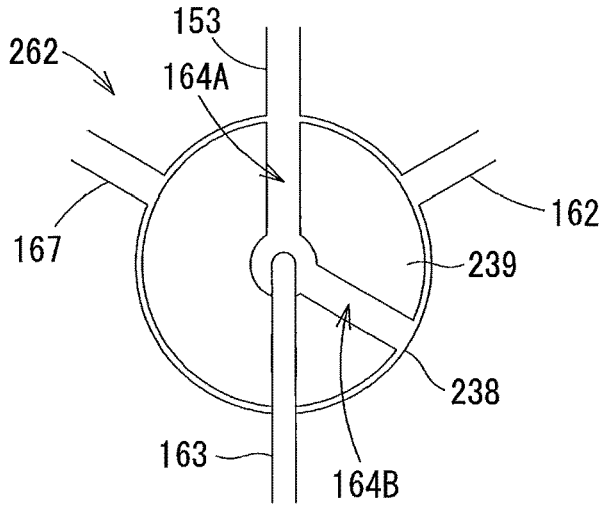
FIG. 15B is a schematic diagram of the switch mechanism 62 according to the first modification, and illustrating a state where a nozzle suction port 153 is in communication with the pump port 163.

When the rotary body 239 is at the position (rotational phase) illustrated in FIG. 15B, the nozzle suction port 153 is in communication with the suction port 154 as similar to the state in FIG. 10B.

Figure 15C:
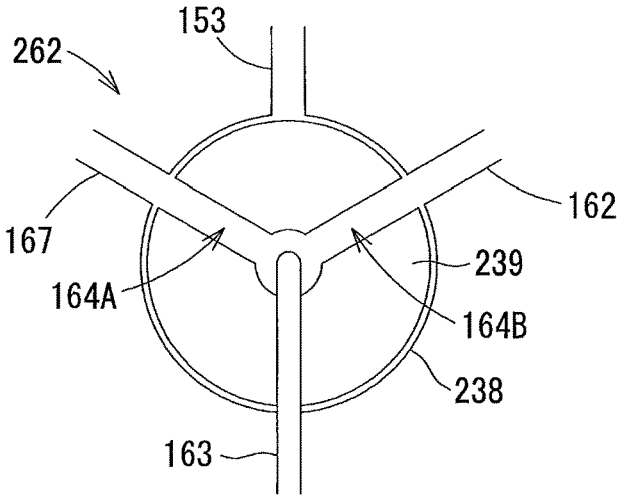
FIG. 15C is a schematic diagram of the switch mechanism 62 according to the first modification, and illustrating a state where the exhaust port 162, an air port 167, and the suction port 154 are in communication with each other.

When the rotary body 239 is at the position (rotational phase) illustrated in FIG. 15C, both the exhaust port 162 and the air port 167 are in communication with the suction port 154. That is, the storage chamber 121 and the damper chamber 44 are open to the atmosphere through the air port 167.

In the switch mechanism 262 according to the first modification, when the rotary body 239 is rotated to the position (rotational phase) illustrated in FIG. 15A and the pump-driving motor 176 is driven to make forward rotation, the switch mechanism 262 is placed in the suction state. Further, when the rotary body 239 is rotated to the position (rotational phase) illustrated in FIG. 15C, the switch mechanism 262 is placed in the open state.

In an initial ink introduction process performed in the first modification, in S20 illustrated in FIG. 14, the controller 130 controls the rotary body-driving motor 174 to rotate the rotary body 239 to the position (rotational phase) illustrated in FIG. 15A. Further, in S40 illustrated in FIG. 14, the controller 130 controls the rotary body-driving motor 174 to rotate the rotary body 239 to the position (rotational phase) illustrated in FIG. 15C.

Second Modification

In the above-described embodiment, the storage chamber 121 is open to the atmosphere through the air communication port 124. However, a configuration capable of switching communication state of the storage chamber 121 with the atmosphere may be provided. In a second modification of the embodiment, the multifunction peripheral 10 includes a switch mechanism 61 (an example of a second switch) illustrated in FIGS. 16A and 16B in order to switch communication and interrupt of the storage chamber 121 with the atmosphere. The switch mechanism 61 is configured to be switched between a first state allowing communication of the air flow path 120 with the atmosphere, and a second state preventing communication of the air flow path 120 with the atmosphere.

Figure 16A:
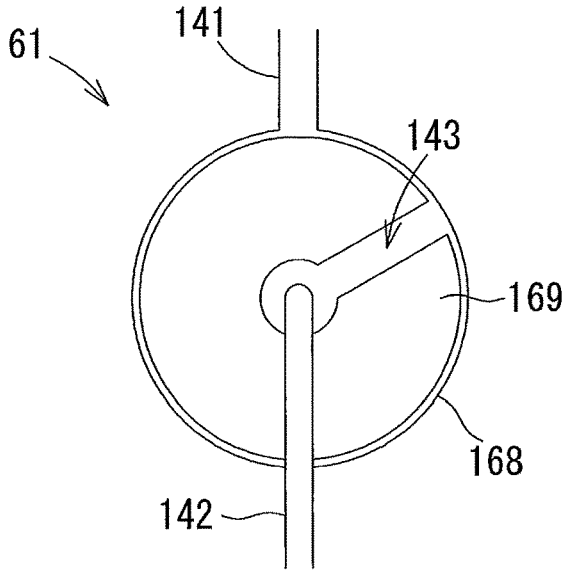
FIG. 16A is a schematic diagram of a switch mechanism 61 according to a second modification, and illustrating a state where communication between a tank port 141 and an air port 142 is interrupted.
Figure 16B:
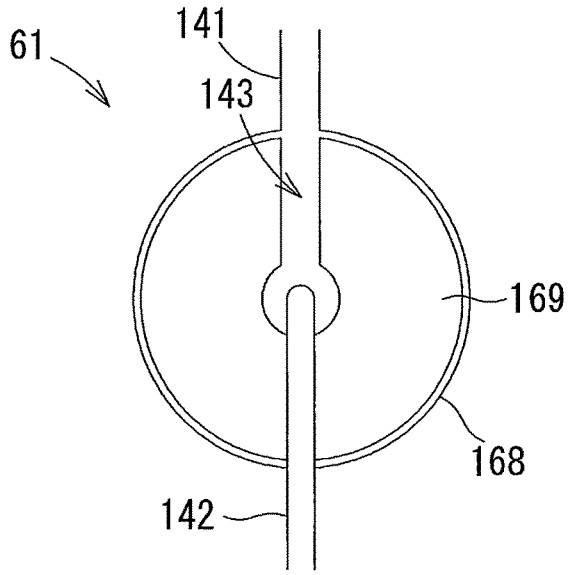
FIG. 16B is a schematic diagram of the switch mechanism 61 according to the second modification, and illustrating a state where the tank port 141 is in communication with the air port 142.

As illustrated in FIGS. 16A and 16B, the switch mechanism 61 includes a cylinder 168 having a hollow cylindrical shape and a rotary body 169 disposed within the cylinder 168.

A tank port 141 and an air port 142 are provided at the cylinder 168. The tank port 141 is in communication with the air communication port 124 (see FIGS. 5, 6, and 9) of the tank 103 through a tube (not illustrated). The air port 142 is communicated with the atmosphere. The cylinder 168 and the rotary body 169 provide a space 143 therebetween. The space 143 is in communication with the air port 142.

The rotary body 169 receives driving force from a motor (not illustrated) controlled by the controller 130 to be rotated inside the cylinder 168. As the rotary body 169 is rotated within the cylinder 168, communication state between the tank port 141 and the air port 142 is configured to be switched. That is, the controller 130 controls the motor to switch a state of the switch mechanism 61. When the rotary body 169 is at the position (rotational phase) illustrated in FIG. 16B, the tank port 141 and the air port 142 are in communication with each other through the space 143. As a result, the storage chamber 121 is open to the atmosphere. That is, the state illustrated in FIG. 16B is the first state of the switch mechanism 61. On the other hand, when the rotary body 169 is at the position (rotational phase) illustrated in FIG. 16A, the tank port 141 and the air port 142 are not communicated with each other. At this time, the storage chamber 121 is not open to the atmosphere. That is, the state illustrated in FIG. 16A is the second state of the switch mechanism 61.

In an initial ink introduction process according to the second modification, in S20 illustrated in FIG. 14, the controller 130 controls the motor to rotate the rotary body 169 to the position (rotational phase) illustrated in FIG. 16A, thereby switching the switch mechanism 61 in the second state. As a result, when the controller 130 executes the process in S30 illustrated in FIG. 14, communication between the storage chamber 121 and the atmosphere is interrupted.

According to the second modification, communication between the storage chamber 121 and the atmosphere is interrupted at a time of execution of the first suction process (S30). Accordingly, suction of the ink stored in the storage chamber 121 can be efficiently performed.

Further, in the initial ink introduction process according to the second modification, in S40 illustrated in FIG. 14, the controller 130 controls the motor to rotate the rotary body 169 to the position (rotational phase) illustrated in FIG. 16B. As a result, the switch mechanism 61 is switched to the first state, thereby opening the storage chamber 121 to the atmosphere.

According to the second modification, when the controller 130 executes the process in S40, the storage chamber 121 is open to the atmosphere through the damper chamber 44 as well as the air flow path 120. As a result, the ink flowing into the ink tube 20 during the first suction process (S30) can efficiently flow back to the storage chamber 121 of the tank 103 due to hydraulic head difference. Further, when the open process (S40) is executed by the controller 130, the ink stored in the ink cartridge 30 efficiently flows into the storage chamber 121 of the tank 103 due to hydraulic head difference.

Note that the rotary body 169 of the switch mechanism 61 may be rotated due to the driving of the rotary body-driving motor 174 as similar to the rotary body 139 of the switch mechanism 62. Further, the cylinder 168 and the rotary body 169 of the switch mechanism 61 may be integrally formed with the cylinder 138 and rotary body 139 of the switch mechanism 62, respectively. In this case, the configurations (for example, positions of the ports provided at the cylinder) of the switch mechanism 61 and the switch mechanism 62 are determined so that the above-described initial ink introduction process is appropriately performed.

Other Modifications

In the initial ink introduction process according to the above-described embodiment, the controller 130 executes the process from S20 at a timing when the signal outputted from each attachment sensor 113 changes to a low-level to a high-level. However, the process in S20 may be executed at a timing other than the timing described above. For example, the controller 130 may execute the process in S20 after a predetermined period of time has elapsed since the signal outputted from each attachment sensor 113 is changed from a high-level to a low-level. The predetermined period of time is arbitral period of time. For example, through the elapse of the predetermined period of time after attachment of the ink cartridge 30 to the cartridge-attachment portion 110, the liquid level of the ink supplied from the ink cartridge 30 to the storage chamber 121 is allowed to reach the same height as the upper end of the communication port 128 in the up-down direction 7 due to hydraulic head difference.

In the above-described embodiment, the roller 53 of the pump 150 at the first position presses the pump tube 54, while the roller 53 at the second position does not press the pump tube 54. However, the roller 53 may press the pump tube 54 irrespective of whether the roller 53 is at the first position or the second position. Note that, even when the roller 53 at the second position is configured to press the pump tube 54, the roller 53 at the second position imparts a pressing force upon the pump tube 54 greater than a pressing force of the roller 53 at the first position, as in the above-described embodiment.

In the above-described embodiment, open and close of the valves 182 of the exhaust unit 165 enables the communication between the damper chambers 44 and the corresponding exhaust ports 162 to be switched. However, the switch mechanism 62 need not necessarily include the valves 182. In case that the switch mechanism 62 does not include the valves 182, the damper chambers 44 and the corresponding exhaust ports 162 are always in communication with each other through the corresponding flow paths 181 and tubes 147. In this case, switch of communication state of the damper chambers 44 with the atmosphere is allowed due to switch of the communication between the exhaust ports 162 and the pump port 163, or switch of communication between the exhaust ports 162 and the air port 167 (the first modification).

The switch mechanism 62 may employ another configuration different from the configuration described in the above-described embodiment provided that the switch mechanism 62 is switched between the open state and the suction state so as to be capable of switching the communication state between the damper chambers 44 and the suction port 154.

The switch mechanism 61 may have a configuration other than the configuration described in the second modification provided that the switch mechanism 61 can be switched between the first state and the second state to change the communication state of the air flow path 120 with the atmosphere.

In the above-described embodiment, the liquid level of the ink stored in the storage chamber 121 of the tank 103 becoming lower than the position P1 is detected based on the pivotal movement of the pivoting member 190 disposed in the storage chamber 121 of each tank 103. However, the detection may be made by any method other than the pivotal movement of the pivoting member 190.

For example, a prism may be disposed in the storage chamber 121 of each tank 103 at the same height as the position P1 in the up-down direction 7. Whether the liquid level of the ink stored in the storage chamber 121 of the tank 103 is lower than or equal to the position P1 may be determined on a basis of a travelling direction of light incident on the prism that may vary depending on whether or not the liquid level is higher than the prism, that is, on a basis of a state of light incident on the prism. In this case, the prism corresponds to a detected portion. Further, an optical sensor that irradiates the prism with light corresponds to a sensor. The change of state of the detected portion denotes change of state for transmission of light with which the prism as the detected portion is irradiated.

Alternatively, for example, of the walls defining the storage chamber 121, a portion positioned at the same height as at least the position P1 in the up-down direction 7 may be formed of a material having a transmissive-property, thereby serving as a transmissive portion. In this case, an optical transmissive sensor including a light-emitting portion and a light-receiving portion may be provided outside the storage chamber 121.

When the liquid level of the ink stored in the storage chamber 121 is above the position P1, light emitted from the light-emitting portion and incident into the storage chamber 121 is attenuated with ink stored in the storage chamber 121 before the light reaches the light-receiving portion of the transmissive sensor. On the other hand, when the liquid level of the ink stored in the storage chamber 121 is lower than or equal to the position P1, light emitted from the light-emitting portion reaches the light-receiving portion of the transmissive sensor without being attenuated by ink stored in the storage chamber 121.

As described above, whether the liquid level of the ink stored in the storage chamber 121 of the tank 103 is lower than or equal to the position P1 may be determined depending on whether the ink stored in the storage chamber 121 attenuates light emitted from the light-emitting portion before reaching the light-receiving portion of the optical transmissive sensor. That is, whether the liquid level is lower than or equal to the position P1 may be determined on a basis of attenuated state of light emitted incident on the transmissive portion of the storage chamber 121.

In this case, the transmissive portion corresponds to a detected portion. Further, in this case, optical transmissive sensor corresponds to a sensor. The state of attenuated light corresponds to a state of the detected portion. The change of state of the detected portion denotes change of state of light incident into the transimissive portion as the detected portion.

Alternatively, for example, two electrodes may be disposed in the storage chamber 121 of each tank 103. The two electrodes are mounted on a substrate (not illustrated). One of the two electrodes may have a lower end at a position slightly higher than the position P1, while the other of the two electrodes may have a lower end at a position below the position P1. Whether the liquid level of the ink stored in the storage chamber 121 of the tank 103 is lower than or equal to the position P1 may be determined depending on whether or not current flows between the two electrodes through the ink. In this case, the two electrodes correspond to a detected portion. Further, a portion (circuit) mounted on the substrate and configured to detect the current corresponds to a sensor. The change of state of the detected portion denotes change of state of establishment of electrical connection between the two electrodes as the detected portion.

In the above-described embodiment, the printer portion 11 of the multifunction peripheral 10 is a serial printer in which the carriage 22 on which the recording head 21 is mounted is reciprocated in the left-right direction 9. However, the printer portion 11 may be a line printer on which a line head that covers the entire passing area in the left-right direction 9 is mounted. In this case, the recording portion 24 includes a line head and the damper chambers 44.

While the description has been made in detail with reference to the embodiment(s) thereof, it would be apparent to those skilled in the art that many modifications and variations may be made therein without departing from the scope of the disclosure.

What is claimed is:

1. An inkjet recording apparatus to which a cartridge is attachable, the cartridge being formed with a storage space for storing ink and comprising a first air flow path allowing the storage space to be communicated with an atmosphere, the inkjet recording apparatus comprising:

a tank comprising:

a storage chamber for storing ink supplied from the cartridge;

an outlet port through which the ink stored in the storage chamber is allowed to flow out; and a second air flow path configured to allow the storage chamber to be communicated with the atmosphere;

a recording portion comprising:

a damper chamber for storing ink supplied from the storage chamber, the damper chamber being positioned higher than the outlet port in an up-down direction and fluidly communicated with the storage chamber; and a recording head comprising a nozzle and configured to eject the ink stored in the damper chamber through the nozzle;

an ink passage configured to communicate the storage chamber with the damper chamber, the ink stored in the storage chamber being supplied to the damper chamber through the outlet port and the ink passage;

a pump configured to suck fluid in the damper chamber;

a first switch configured to be switched between a first state and a second state, wherein when the first switch in the first state enables the pump to suck the fluid in the damper chamber whereas the first switch in the second state causes the pump not to suck the fluid in the damper chamber, wherein the first switch in the first state is configured to interrupt fluid communication of the damper chamber with the atmosphere whereas the first switch in the second state allows the fluid communication of the damper chamber with the atmosphere; and a controller capable of controlling the first switch and the pump, the controller being configured to perform:

after attachment of the cartridge to the inkjet recording apparatus, an initial ink introduction process comprising:

a first suction process to drive the pump for a first period of time in a state where the first switch is in the first state, the ink stored in the storage space being sucked toward the damper chamber through the storage chamber during the first period of time; and after performing the first suction process, an open process to switch the first switch to the second state.

2. The inkjet recording apparatus according to claim 1, wherein a volume of the ink sucked from the storage chamber during the first suction process is smaller than a capacity of the ink passage.

3. The inkjet recording apparatus according to claim 1, wherein the second air flow path provides a passage resistance greater than a passage resistance provided by the first air flow path.

4. The inkjet recording apparatus according to claim 1, wherein the pump comprises:

a tube having one end configured to be communicated with the damper chamber and another end communicated with the atmosphere; and a pressing member movable along the tube between a first position and a second position along the tube, the pressing member in the first position imparting a pressing force upon the tube greater than a pressing force of the pressing member in the second position, the pressing member in the first position being movable along the tube in a direction in which the ink is sucked into the damper chamber so that the pump sucks the fluid in the damper chamber, wherein, when the first switch is switched to the first state, the pressing member is moved to the first position to allow the fluid in the damper chamber to be sucked by the pump, and wherein, when the first switch is switched to the second state, the pressing member is moved to the second position to allow the damper chamber to be open to the atmosphere.

5. The inkjet recording apparatus according to claim 1, further comprising a second switch configured to be switched between a first state and a second state, the second switch in the first state allowing the second air flow path to be communicated with the atmosphere, the second switch in the second state interrupting communication of the second air flow path with the atmosphere, wherein the controller is further capable of controlling the second switch, the controller being configured to switch the second switch to the second state in the first suction process.

6. The inkjet recording apparatus according to claim 5, wherein the controller is configured to switch the second switch to the first state in the open process.

7. The inkjet recording apparatus according to claim 1, further comprising:

a detected portion disposed in the storage chamber and configured to change a state depending on whether a liquid level of the ink stored in the storage chamber is higher than a predetermined position, the predetermined position being higher than the outlet port in the up-down direction; and a sensor configured to output different signals to the controller depending on the state of the detected portion, wherein a volume of the ink sucked from the storage chamber during the first suction process is smaller than a capacity of the storage chamber ranging from a position higher than the outlet port to a position lower than the predetermined position.

8. The inkjet recording apparatus according to claim 7, wherein, when the sensor outputs a signal indicative of change of the state of the detected portion, the controller is further configured to perform:

a second suction process to switch the first switch to the first state and to drive the pump for a second period of time longer than the first period of time, the ink stored in the storage chamber being sucked toward the damper chamber during the second period of time.

9. The inkjet recording apparatus according to claim 1, further comprising:

a cartridge-attachment portion to which the cartridge is attachable, ink being supplied from the cartridge attached to the cartridge-attachment portion to the storage chamber; and a sensor configured to output a signal to the controller when the cartridge has been attached to the cartridge-attachment portion, wherein the controller is configured to perform the first suction process when the signal is outputted from the sensor.

* * * * *